US010986912B2

(12) United States Patent
Yeates et al.

(10) Patent No.: US 10,986,912 B2
(45) Date of Patent: Apr. 27, 2021

(54) MODULAR ATTACHMENT MATRIX

(71) Applicant: Sentry Solutions Products Group LLC, Virginia Beach, VA (US)

(72) Inventors: Eric M. Yeates, Virginia Beach, VA (US); Nicholas A. Ferros, Virginia Beach, VA (US)

(73) Assignee: Sentry Solutions Products Group LLC, Virginia Beach, VA (US)

( * ) Notice: Subject to any disclaimer, the term of this patent is extended or adjusted under 35 U.S.C. 154(b) by 0 days.

(21) Appl. No.: 16/470,738

(22) PCT Filed: Dec. 19, 2017

(86) PCT No.: PCT/US2017/067361
§ 371 (c)(1),
(2) Date: Jun. 18, 2019

(87) PCT Pub. No.: WO2018/118954
PCT Pub. Date: Jun. 28, 2018

(65) Prior Publication Data

US 2019/0339039 A1 Nov. 7, 2019

Related U.S. Application Data

(60) Provisional application No. 62/476,771, filed on Mar. 25, 2017, provisional application No. 62/450,481, (Continued)

(51) Int. Cl.
*A45F 5/00* (2006.01)
*A45C 3/00* (2006.01)
(Continued)

(52) U.S. Cl.
CPC ..... *A45F 5/00* (2013.01); *A41D 1/04* (2013.01); *A41D 15/00* (2013.01); *A41D 27/20* (2013.01);
(Continued)

(58) Field of Classification Search
CPC ..... A41D 13/055; A41D 13/0007; A41D 13/0556; A41D 13/0012; A41D 27/08;
(Continued)

(56) References Cited

U.S. PATENT DOCUMENTS

2012/0180184 A1* 7/2012 Crye ..... A45F 3/14 2/69
2015/0189977 A1* 7/2015 Thompson ..... A45F 5/02 24/3.7
(Continued)

FOREIGN PATENT DOCUMENTS

WO WO2016201363 12/2016

*Primary Examiner* — Corey N Skurdal
(74) *Attorney, Agent, or Firm* — Shaddock Law Group, PC

(57) ABSTRACT

A modular attachment matrix having a matrix layer, wherein the matrix layer comprises a plurality of spaced apart matrix apertures, wherein the matrix apertures are substantially octagonally shaped matrix apertures arranged in a repeating sequence of equally spaced rows of the substantially octagonally shaped matrix apertures and equally spaced columns of the substantially octagonally shaped matrix apertures.

20 Claims, 17 Drawing Sheets

Related U.S. Application Data filed on Jan. 25, 2017, provisional application No. 62/445,934, filed on Jan. 13, 2017, provisional application No. 62/436,399, filed on Dec. 19, 2016.

(51) Int. Cl.

| | |
|---|---|
| ***F41C 33/04*** | (2006.01) |
| ***A45F 5/02*** | (2006.01) |
| ***A41D 1/04*** | (2006.01) |
| ***A41D 15/00*** | (2006.01) |
| ***A41D 27/20*** | (2006.01) |
| ***A45F 3/04*** | (2006.01) |
| *A45C 13/30* | (2006.01) |
| *A45F 3/00* | (2006.01) |

(52) U.S. Cl.

CPC ..... *A45C 3/001* (2013.01); *A45F 3/04* (2013.01); *A45F 5/02* (2013.01); *F41C 33/046* (2013.01); *A41D 2400/48* (2013.01); *A45C 2013/306* (2013.01); *A45F 2003/001* (2013.01)

(58) Field of Classification Search

CPC ..... A41D 27/20; A41D 2300/20; A45F 5/02; A45F 5/033; A45F 2005/023; A45F 2200/05; A45F 2200/0591; F41C 33/04; F41C 33/045

See application file for complete search history.

(56) References Cited

U.S. PATENT DOCUMENTS

2016/0040958 A1* 2/2016 Alcantra ..... A45F 3/06 224/182
2017/0320286 A1* 11/2017 Carlson ..... A41D 1/04

* cited by examiner

MODULAR ATTACHMENT MATRIX

CROSS-REFERENCE TO RELATED APPLICATIONS

This patent application claims the benefit of U.S. Patent Application Ser. No. 62/436,399, filed Dec. 19, 2016, U.S. Patent Application Ser. No. 62/445,934, filed Jan. 13, 2017, U.S. Patent Application Ser. No. 62/450,481, filed Jan. 25, 2017, and U.S. Patent Application Ser. No. 62/476,771, filed Mar. 25, 2017, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of modular attachment systems. More specifically, the presently disclosed systems, methods, and/or apparatuses relates to a modular attachment matrix.

2. Description of Related Art

It is advantageous be able to configure and/or reconfigure various pouches, pockets, holsters, holders, and other accessories on items such as, for example, articles of clothing, vests, plate carriers, backpacks, packs, platforms, and other carriers.

It is generally known to removably attach such items using a MOLLE or other similar attachment system. The term MOLLE (Modular Lightweight Load-carrying Equipment) is used to generically describe load bearing systems and subsystems that utilize corresponding rows of woven webbing for modular pouch, pocket, and accessory attachment.

The MOLLE system is a modular system that incorporates the use of corresponding rows of webbing stitched onto a piece of equipment, such as a vest, and the various MOLLE compatible pouches, pockets, and accessories, each accessory having mating rows of stitched webbing. MOLLE compatible pouches, pockets, and accessories of various utility can then be attached or coupled wherever MOLLE webbing exists on the equipment.

The terms "MOLLE-compatible" or "MOLLE" system are not used to describe a specific system, but to generically describe accessory attachment systems that utilize interwoven PALS (Pouch Attachment Ladder System) webbing for modular accessory attachment.

As illustrated in FIGS. 1-2, an exemplary MOLLE compatible carrier portion 10 includes a plurality of substantially parallel rows of spaced apart, horizontal carrier webbing elements 23. Each of the carrier webbing elements 23 is secured to a backing or carrier material 12, by vertical stitching 24, at spaced apart locations, such that a tunnel segment 27 is formed between the carrier material 12 and the carrier webbing elements 23 between each secured location of the carrier webbing elements 23. Each of the tunnel segments 27 is formed substantially perpendicular to a longitudinal axis or direction of the carrier webbing elements 23.

The MOLLE compatible carrier portion 10, or MOLLE system grid, typically consists of horizontal rows of 1 inch (2.5 cm) webbing, spaced 1 inch apart, and attached or coupled to the carrier material 12 at 1.5 inch (3.8 cm) intervals.

An exemplary accessory 81 includes a plurality of substantially parallel, spaced apart accessory webbing elements 83. The accessory webbing elements 83 are spaced apart so as to correspond to the spaces between the spaced apart carrier webbing elements 23. The accessory webbing elements 83 are secured to the accessory 81 at spaced apart locations, such that an accessory tunnel segment 87 is formed between the accessory 81 and the accessory webbing element 83 between each secured location of the accessory webbing element 83. Each of the accessory tunnel segments 87 is formed substantially perpendicular to a longitudinal direction of the accessory webbing elements 83.

When the accessory 81 is placed adjacent the carrier material 12 such that the accessory webbing elements 83 are within the spaces between the spaced apart carrier webbing elements 23 (and the carrier webbing elements 23 are within the spaces between the spaced apart accessory webbing elements 83) and corresponding tunnel segments 27 and accessory tunnel segments 87 are aligned, a strap or coupling element may be interwoven between the aligned tunnel segments 27 and accessory tunnel segments 87 (alternating between horizontal carrier webbing element 23 portions on the host or carrier material 12 and horizontal webbing portions on the accessory 81) to removably attach the accessory 81 to the carrier material 12.

Thus, through the use of a MOLLE or MOLLE-type system, an accessory 81 may be mounted to a variety of carrier materials 12. Likewise, if a particular carrier material 12 includes a MOLLE compatible system, a variety of accessories may be interchangeably mounted to the platform to accommodate a variety of desired configurations.

MOLLE compatible systems allow, for example, various pouch arrangements to be specifically tailored to a desired configuration and then reconfigured, if desired. Various desired pouches, pockets, and accessories can be added and undesired or unnecessary pouches, pockets, or accessories can be removed.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, the typical "MOLLE-compatible" or "MOLLE" system arrangement has various shortcomings. For example, known "MOLLE-compatible" or "MOLLE" systems only allow for attachment of accessories in a single orientation relative to the carrier webbing elements. In most applications, this results in only vertical attachment of accessories to the MOLLE system, i.e., attachment perpendicular to the longitudinal axis, $A_L$, of the carrier webbing elements.

In various exemplary, non-limiting embodiments, the modular attachment matrix of the presently disclosed systems, methods, and/or apparatuses provides a matrix layer that allows MOLLE-compatible or similar accessories to be attached or coupled to the matrix layer in a vertical, horizontal, oblique, or diagonal manner, relative to a row or column of spaced apart matrix apertures.

In various exemplary, nonlimiting embodiments, the modular attachment matrix of the present disclosure includes at least some of a portion of carrier material; and a matrix layer, wherein the matrix layer comprises a plurality of spaced apart matrix apertures, wherein the matrix apertures are arranged in a repeating or semi-repeating series or sequence of equally spaced rows and equally spaced columns, and wherein the matrix layer is at least partially attached or coupled to at least a portion of the carrier material.

In certain exemplary, nonlimiting embodiments, the matrix tunnel segments are created between adjacent matrix apertures, whether the adjacent matrix apertures are created between vertically adjacent matrix apertures, horizontally adjacent matrix apertures, obliquely adjacent matrix apertures, or diagonally adjacent matrix apertures.

In certain exemplary, nonlimiting embodiments, each adjacent column of spaced apart matrix apertures is offset such that either edges or proximate centers of adjacent matrix apertures are offset by approximately ±45° or ±90°.

In certain exemplary, nonlimiting embodiments, each matrix aperture is separated from each other matrix aperture by a distance that is equal to or greater than a width of each matrix aperture.

In certain exemplary, nonlimiting embodiments, the matrix layer comprises chlorosulfonated polyethylene (CSPE) synthetic rubber (CSM). In certain exemplary, nonlimiting embodiments, the matrix layer comprises a portion of Hypalon fabric.

In various exemplary, nonlimiting embodiments, the modular attachment matrix of the present disclosure includes at least some of a matrix layer, wherein the matrix layer comprises a plurality of spaced apart matrix apertures, wherein the matrix apertures are arranged in a repeating or semi-repeating series or sequence of equally spaced rows and equally spaced columns. In these exemplary embodiments, the matrix layer may optionally be at least partially attached or coupled to at least a portion of a carrier material.

In various exemplary, nonlimiting embodiments, the modular attachment matrix of the present disclosure comprises at least some of a portion of carrier material; and a matrix layer, wherein the matrix layer comprises a plurality of spaced apart matrix apertures, wherein each of the matrix apertures is formed through the matrix layer and is defined by one or more continuous edges, and wherein the matrix apertures are arranged in a repeating sequence of equally spaced rows and equally spaced columns, and wherein the matrix layer is at least partially attached or coupled to at least a portion of the carrier material.

In various exemplary, nonlimiting embodiments, the plurality of spaced apart matrix apertures comprises spaced apart, substantially octagonally shaped matrix apertures arranged in a repeating sequence of equally spaced rows of the substantially octagonally shaped matrix apertures and equally spaced columns of the substantially octagonally shaped matrix apertures.

In various exemplary, nonlimiting embodiments, matrix tunnel segments are created between adjacent matrix apertures.

In various exemplary, nonlimiting embodiments, the matrix tunnel segments are created between vertically adjacent matrix apertures, between horizontally adjacent matrix apertures, between obliquely adjacent matrix apertures, and/or between diagonally adjacent matrix apertures.

In various exemplary, nonlimiting embodiments, the modular attachment matrix further comprises one or more alternate attachment apertures formed through the matrix layer at spaced apart locations, wherein each alternate attachment aperture, and wherein the alternate attachment apertures are arranged in a repeating sequence of equally spaced rows and equally spaced columns.

In various exemplary, nonlimiting embodiments, each adjacent column of spaced apart matrix apertures is offset such that at least edges or proximate centers of adjacent matrix apertures are offset by approximately ±45°. Alternatively, each adjacent column of spaced apart matrix apertures is offset such that at least edges or proximate centers of adjacent matrix apertures are offset by approximately ±90°.

In various exemplary, nonlimiting embodiments, each matrix aperture is separated from each other matrix aperture by a distance that is equal to or greater than a width of each matrix aperture.

In various exemplary, nonlimiting embodiments, the matrix layer comprises chlorosulfonated polyethylene (CSPE) synthetic rubber (CSM).

In various exemplary, nonlimiting embodiments, the matrix layer comprises a portion of Hypalon fabric.

In various exemplary, nonlimiting embodiments, the modular attachment matrix of the present disclosure comprises at least some of a matrix layer, wherein the matrix layer comprises a plurality of spaced apart matrix apertures, wherein each of the matrix apertures is formed through the matrix layer and is defined by one or more continuous edges, and wherein the matrix apertures are arranged in a repeating or semi-repeating series or sequence of equally spaced rows and equally spaced columns.

In various exemplary, nonlimiting embodiments, the modular attachment matrix of the present disclosure comprises at least some of a matrix layer, wherein the matrix layer comprises a plurality of spaced apart matrix apertures, wherein the matrix apertures are substantially octagonally shaped matrix apertures arranged in a repeating sequence of equally spaced rows of the substantially octagonally shaped matrix apertures and equally spaced columns of the substantially octagonally shaped matrix apertures.

Accordingly, the presently disclosed systems, methods, and/or apparatuses separately and optionally provide a modular attachment matrix that allows a user to readily attach MOLLE-compatible or similar accessories to the matrix layer in a vertical, horizontal, oblique, or diagonal manner.

The presently disclosed systems, methods, and/or apparatuses separately and optionally provide a modular attachment matrix that allows a user to attach an accessory to the matrix layer by interweaving an accessory coupling element between aligned matrix tunnel segments and accessory tunnel segments to removably attach the accessory to the matrix layer.

These and other aspects, features, and advantages of the presently disclosed systems, methods, and/or apparatuses are described in or are apparent from the following detailed description of the exemplary, non-limiting embodiments of the presently disclosed systems, methods, and/or apparatuses and the accompanying figures. Other aspects and features of embodiments of the presently disclosed systems, methods, and/or apparatuses will become apparent to those of ordinary skill in the art upon reviewing the following description of specific, exemplary embodiments of the presently disclosed systems, methods, and/or apparatuses in concert with the figures.

While features of the presently disclosed systems, methods, and/or apparatuses may be discussed relative to certain embodiments and figures, all embodiments of the presently disclosed systems, methods, and/or apparatuses can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the presently disclosed systems, methods, and/or apparatuses.

Any benefits, advantages, or solutions to problems that are described herein with regard to specific embodiments are not intended to be construed as a critical, required, or essential feature(s) or element(s) of the presently disclosed systems, methods, and/or apparatuses or the claims.

BRIEF DESCRIPTION OF THE SEVERAL VIEWS OF THE DRAWINGS

As required, detailed exemplary embodiments of the presently disclosed systems, methods, and/or apparatuses are disclosed herein; however, it is to be understood that the disclosed embodiments are merely exemplary of the presently disclosed systems, methods, and/or apparatuses that may be embodied in various and alternative forms, within the scope of the presently disclosed systems, methods, and/or apparatuses. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the presently disclosed systems, methods, and/or apparatuses.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
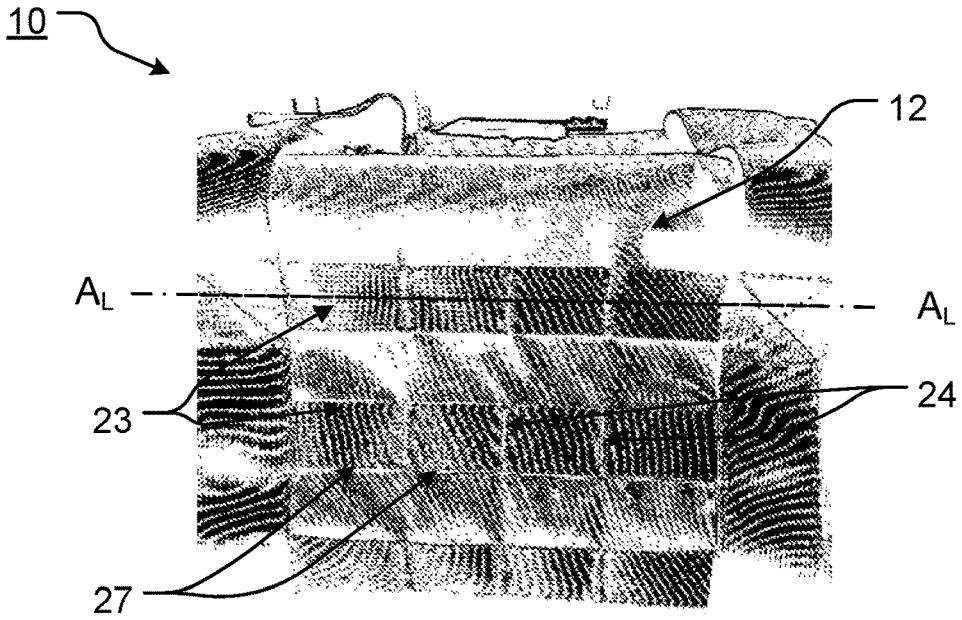
FIG. 1 PRIOR ART
FIG. 1 illustrates a portion of a known MOLLE compatible carrier portion attached or coupled to a carrier material.

For simplicity and clarification, the design factors and operating principles of the modular attachment matrix according to the presently disclosed systems, methods, and/or apparatuses are explained with reference to various exemplary embodiments of a modular attachment matrix according to the presently disclosed systems, methods, and/or apparatuses. The basic explanation of the design factors and operating principles of the modular attachment matrix is applicable for the understanding, design, and operation of the modular attachment matrix of the presently disclosed systems, methods, and/or apparatuses. It should be appreciated that the modular attachment matrix can be adapted to many applications where a modular attachment matrix can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "modular attachment matrix", "matrix layer", "carrier material", and "accessory" are used for basic explanation and understanding of the operation of the systems, methods, and apparatuses of the presently disclosed systems, methods, and/or apparatuses. Therefore, the terms "modular attachment matrix", "matrix layer", "carrier material", and "accessory" are not to be construed as limiting the systems, methods, and apparatuses of the presently disclosed systems, methods, and/or apparatuses.

For simplicity and clarification, the modular attachment matrix of the presently disclosed systems, methods, and/or apparatuses will be shown and/or described as being used in conjunction with a side portion or surface of an exemplary bag or pack being utilized as an exemplary carrier material. However, it should be appreciated that these are merely exemplary embodiments of the modular attachment matrix and are not to be construed as limiting the presently disclosed systems, methods, and/or apparatuses. Thus, the modular attachment matrix of the presently disclosed systems, methods, and/or apparatuses may be utilized in conjunction with any object or device.

Additionally, the modular attachment matrix of the presently disclosed systems, methods, and/or apparatuses will be shown and described as being used in conjunction with a compatible accessory 81, having at least one accessory webbing element 83, and at least one accessory coupling element 88. It should be appreciated that the compatible accessory 81 is merely an exemplary accessory and that any MOLLE compatible or similar accessory may be utilized in conjunction with the modular attachment matrix of the present disclosure.

Figure 2:
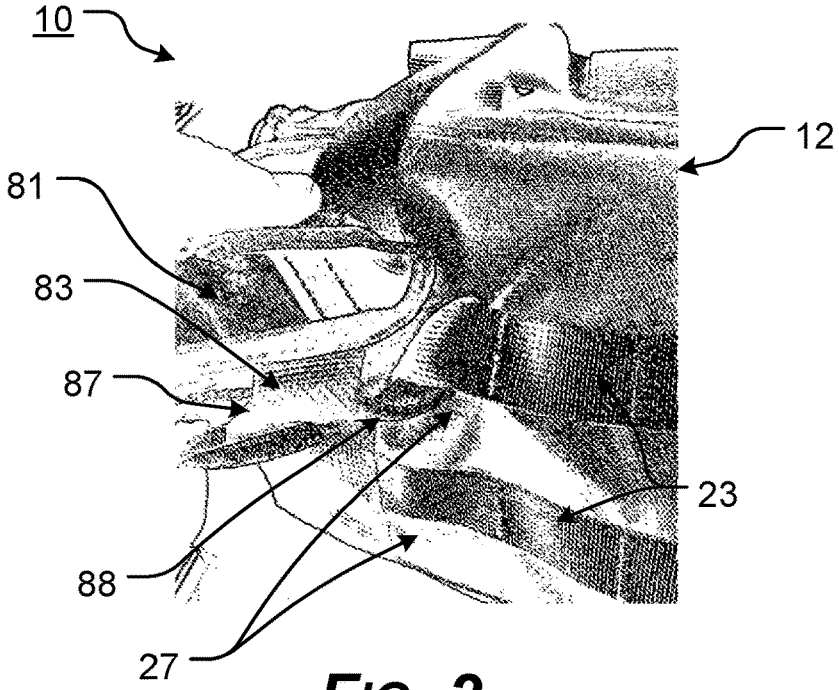
FIG. 2 PRIOR ART
FIG. 2 illustrates a MOLLE-compatible accessory being attached or coupled to a portion of a known MOLLE compatible carrier portion.
Figure 3:
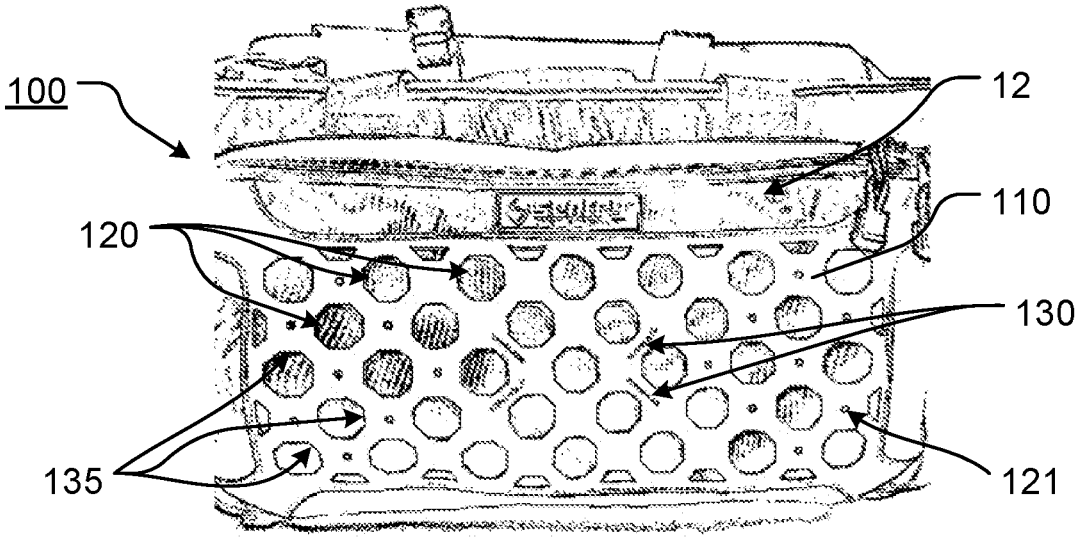
FIG. 3 illustrates an exemplary embodiment of the modular attachment matrix attached or coupled to a carrier material, according to the presently disclosed systems, methods, and/or apparatuses.

Turning now to the appended drawing figures, FIGS. 1-2 illustrate certain elements and/or aspects of a portion of a known MOLLE compatible carrier portion 10 attached or coupled to a carrier material 12 and a MOLLE-compatible accessory 81 being attached or coupled to a portion of a known MOLLE compatible carrier portion 10, while FIGS. 3-31 illustrate certain elements and/or aspects of an exemplary embodiment of the modular attachment matrix 100, according to the presently disclosed systems, methods, and/or apparatuses.

In certain illustrative, non-limiting embodiment(s) of the presently disclosed systems, methods, and/or apparatuses, as illustrated in FIGS. 3-31, the modular attachment matrix 100 comprises at least some of a matrix layer 110 having a plurality of spaced apart matrix apertures 120 formed therethrough.

In certain exemplary embodiments, the matrix layer 110 is formed of a portion of a fabric-type or other material, such as, for example, chlorosulfonated polyethylene (CSPE) synthetic rubber (CSM). In certain exemplary embodiments, the matrix layer 110 is formed of a portion of Hypalon fabric. However, the present disclosure is not so limited. For example, in certain exemplary embodiments, the matrix layer 110 may be formed of a rigid material, a semi-rigid material, or a substantially flexible material.

In various exemplary, non-limiting embodiments, all or portions of the matrix layer 110 may be made of any fabric or other material, such as, for example, woven fabrics, canvas, acrylics, sheet fabrics, films, nylon, spandex, vinyl, Polyvinyl Chloride (PVC), neoprene, or the like. Alternatively, all or portions of the matrix layer 110 may be formed from multiple, similar or dissimilar materials. In various exemplary, non-limiting embodiments, the matrix layer 110 may be water-resistant or may include a cushion material.

As a further example, in certain exemplary embodiments, the matrix layer 110 may be formed of a substantially rigid material, such as plastic, having an appropriate, workable thickness. Alternate materials of construction of the matrix layer 110 may include one or more of the following: steel, stainless steel, aluminum, titanium, polytetrafluoroethylene, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the matrix layer 110 is a design choice based on the desired appearance and functionality of the matrix layer 110.

It should be appreciated that the terms fabric and material are to be given their broadest meanings and that the particular fabric(s) or material(s) used to form the matrix layer 110 is a design choice based on the desired appearance and/or functionality of the modular attachment matrix 100. In general, the material used to form the matrix layer 110 is selected for its ability to allow a MOLLE-type accessory to be attached or coupled thereto.

The modular attachment matrix 100 of the present disclosure is operable with as few as two matrix apertures 120. Thus, the size and shape of the matrix layer 110 is a design choice, based upon, for example, the size and shape of the carrier material 12 or portion of carrier material 12 that is desired to potentially accept attachment or coupling of accessories.

Figure 4:
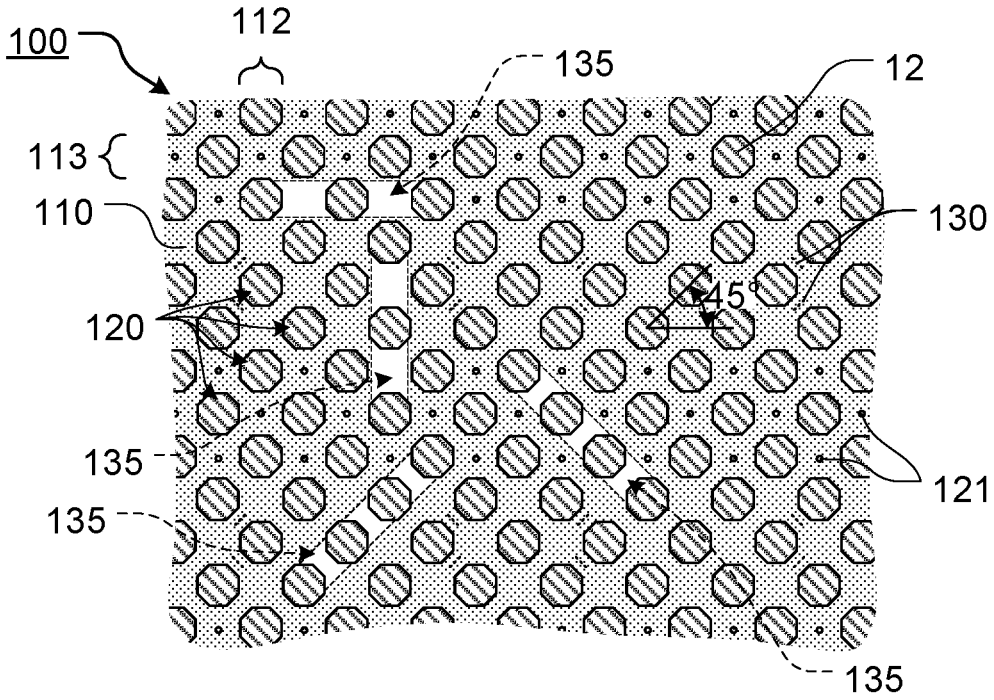
FIG. 4 illustrates a more detailed view of an exemplary embodiment of the modular attachment matrix, wherein the modular attachment matrix comprises substantially octagonally shaped matrix apertures, arranged according to an exemplary embodiment of the presently disclosed systems, methods, and/or apparatuses.
Figure 5:
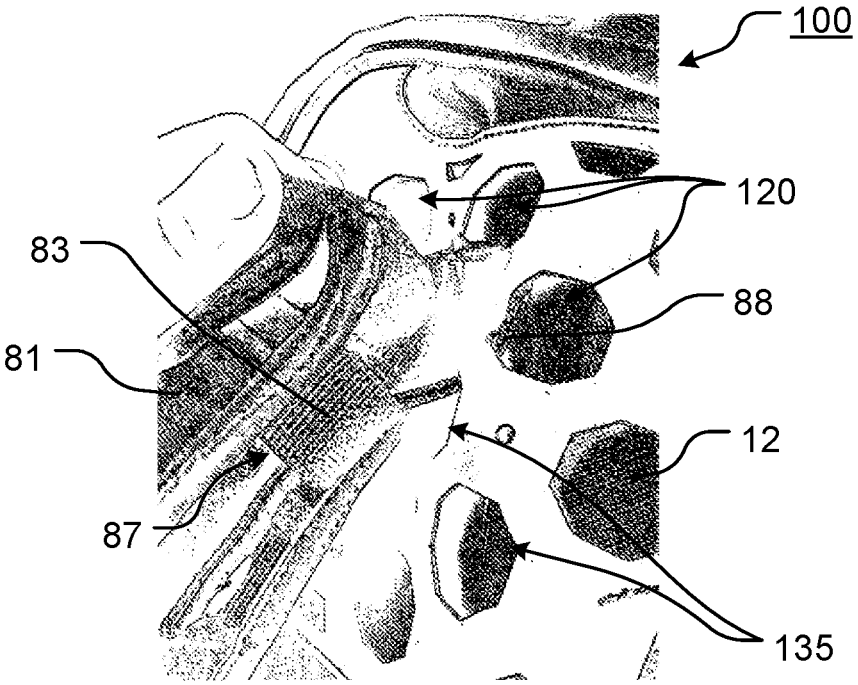
FIG. 5 illustrates a more detailed view of the interaction between the matrix layer of the modular attachment matrix and the accessory coupling element of an exemplary accessory, according to the presently disclosed systems, methods, and/or apparatuses.
Figure 6:
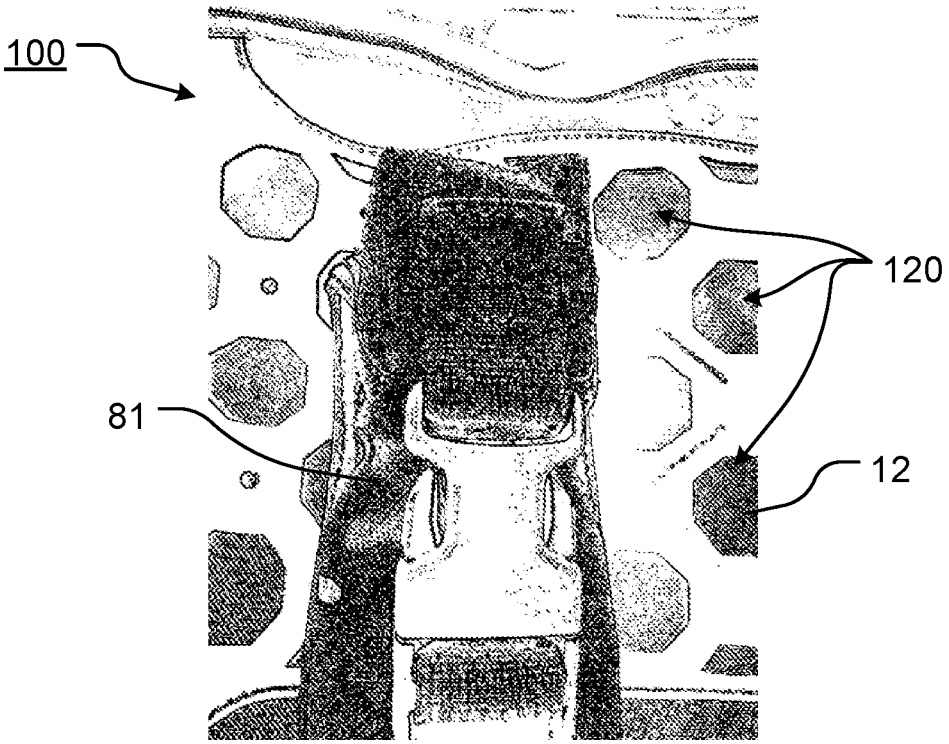
FIG. 6 illustrates an exemplary accessory attached or coupled to the matrix layer of the modular attachment matrix, according to the presently disclosed systems, methods, and/or apparatuses.
Figure 13:
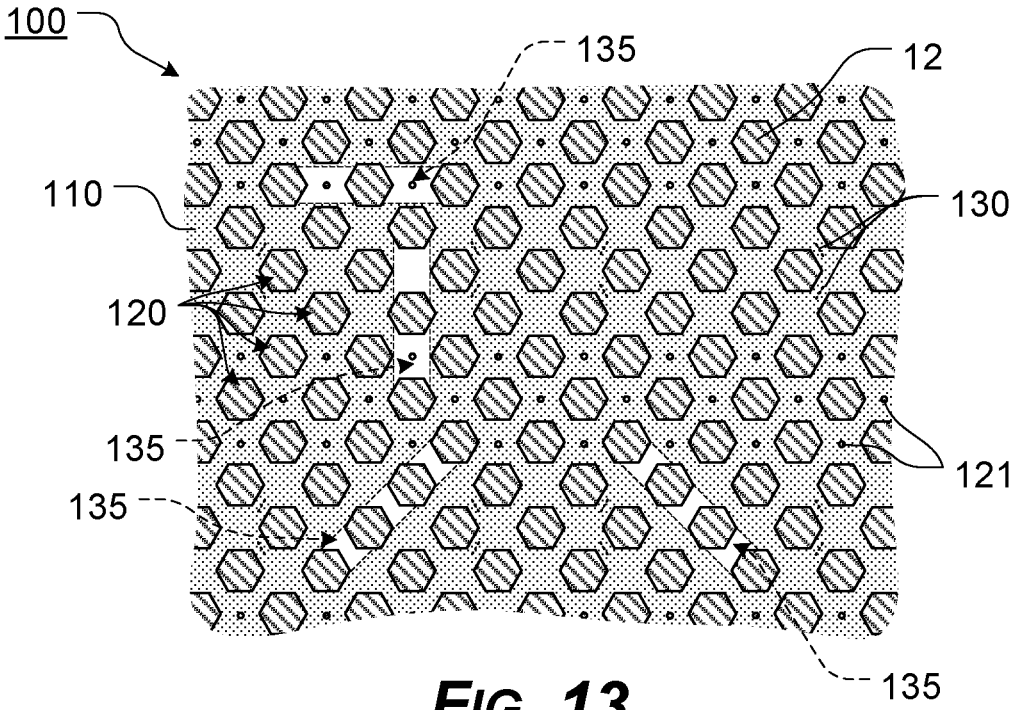
FIG. 13 illustrates an exemplary embodiment of the modular attachment matrix attached or coupled to a carrier material, wherein the modular attachment matrix comprises substantially hexagonally shaped matrix apertures, arranged according to an exemplary embodiment of the presently disclosed systems, methods, and/or apparatuses.
Figure 14:
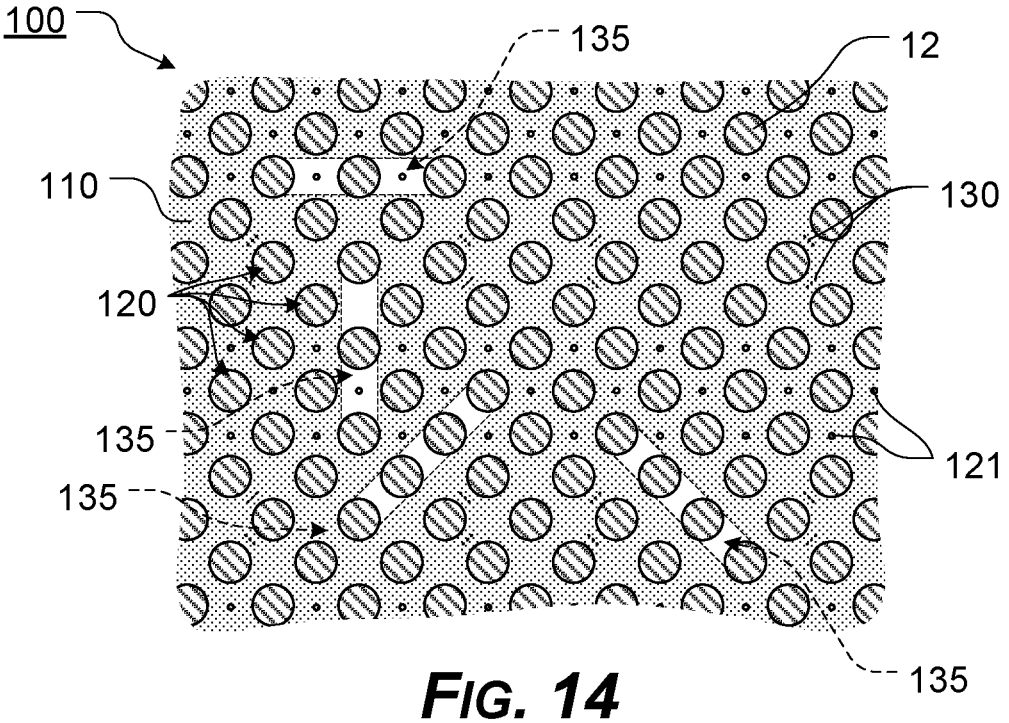
FIG. 14 illustrates an exemplary embodiment of the modular attachment matrix attached or coupled to a carrier material, wherein the modular attachment matrix comprises substantially circular shaped matrix apertures, arranged according to an exemplary embodiment of the presently disclosed systems, methods, and/or apparatuses.
Figure 24:
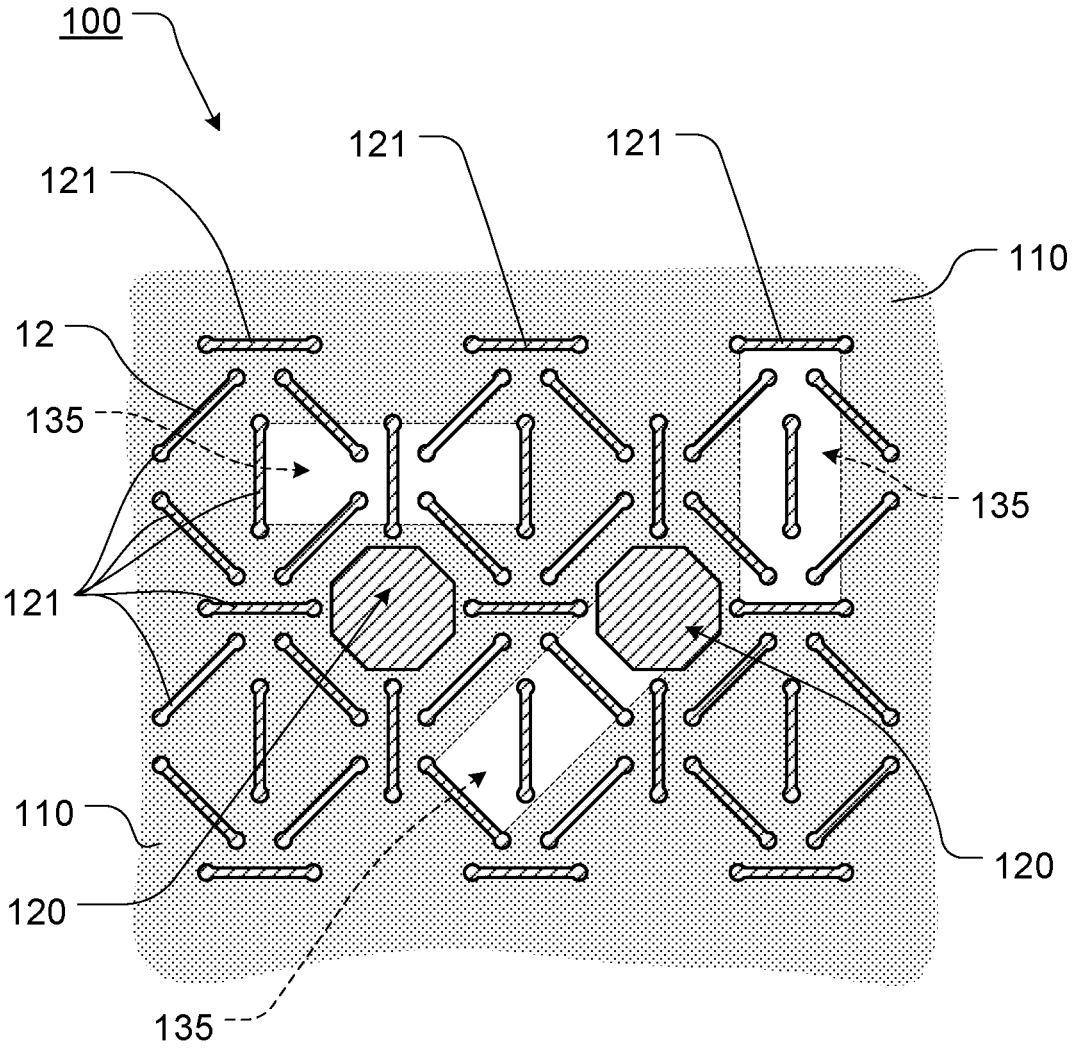
FIG. 24 illustrates an exemplary embodiment of the modular attachment matrix attached or coupled to a carrier material, wherein the modular attachment matrix comprises a plurality of substantially octagonally shaped matrix apertures and a plurality of alternate matrix apertures, arranged according to an exemplary embodiment of the presently disclosed systems, methods, and/or apparatuses.
Figure 25:
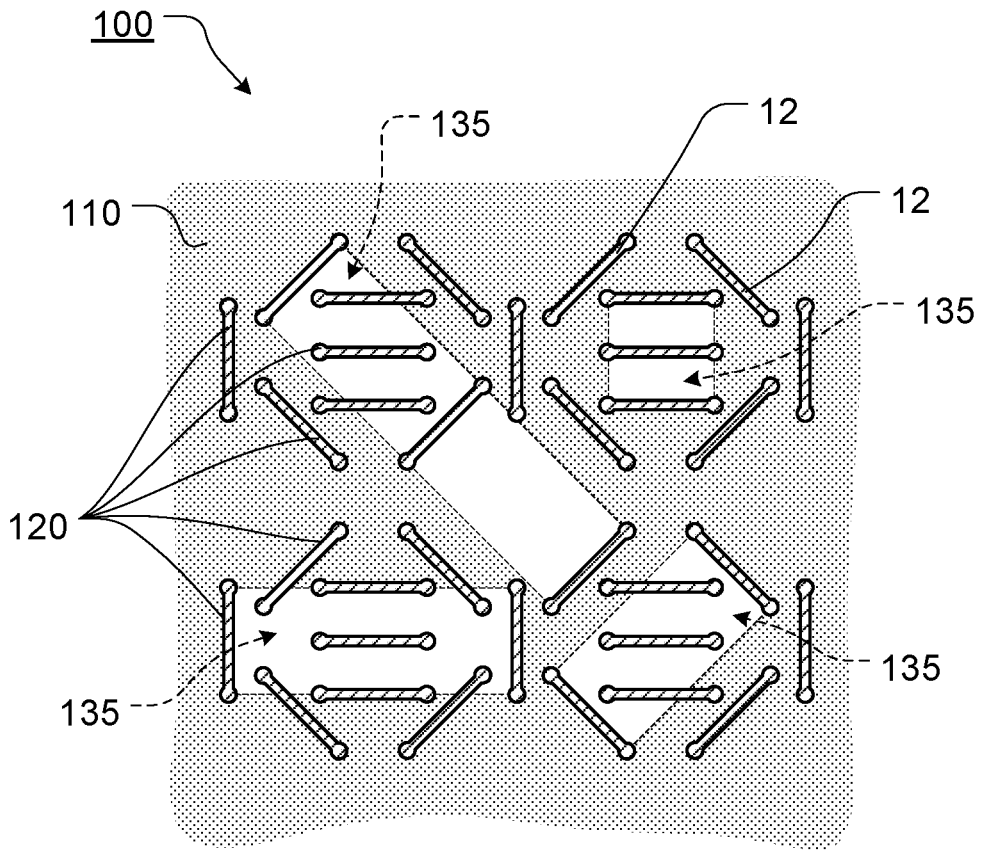
FIG. 25 illustrates an exemplary embodiment of the modular attachment matrix attached or coupled to a carrier material, wherein the modular attachment matrix comprises a plurality of matrix apertures, arranged according to an exemplary embodiment of the presently disclosed systems, methods, and/or apparatuses.
Figure 27:
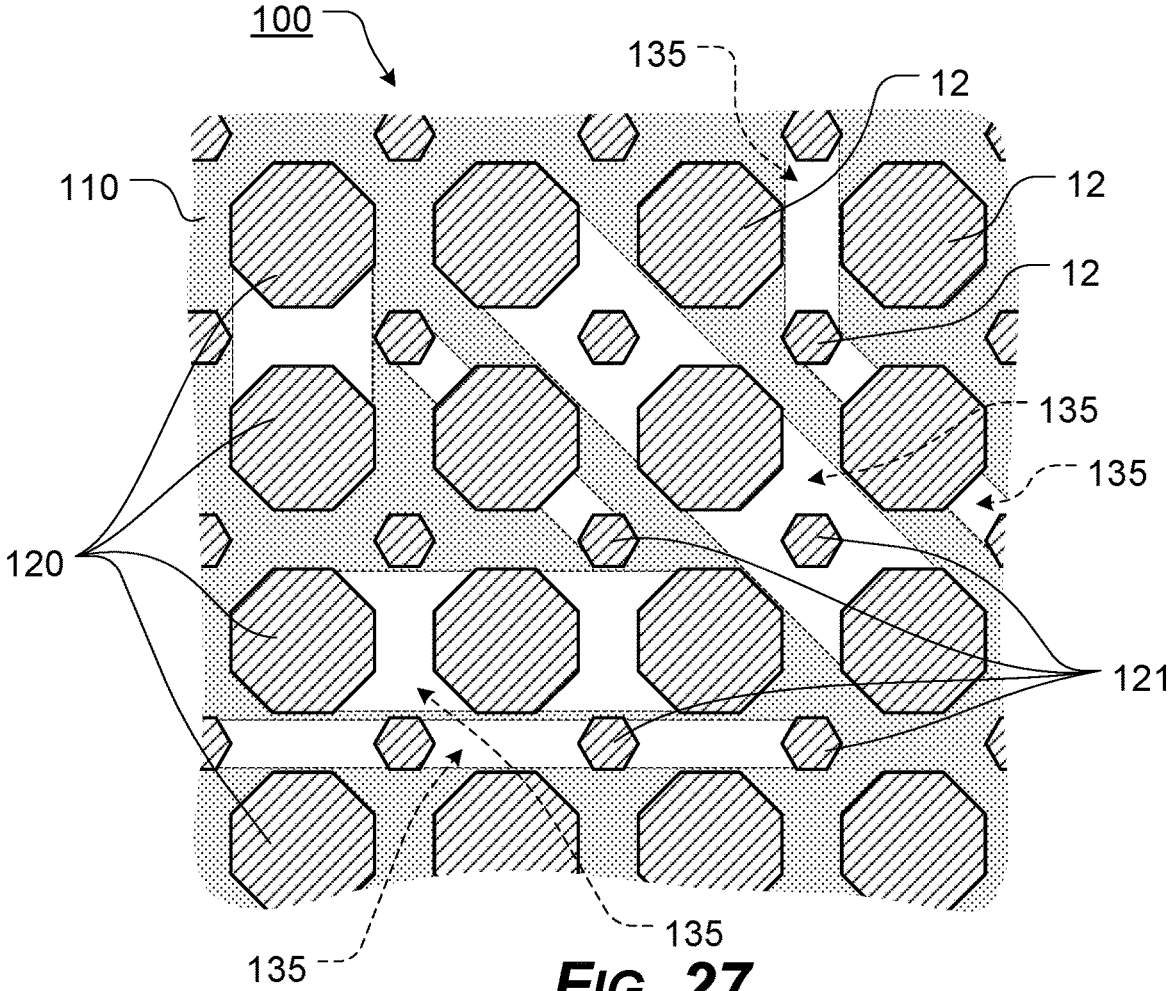
FIG. 27 illustrates the exemplary embodiment of the repeatable modular attachment matrix pattern of FIG. 26 repeated as part of a matrix layer, attached or coupled to a carrier material according to an exemplary embodiment of the presently disclosed systems, methods, and/or apparatuses.
Figure 28:
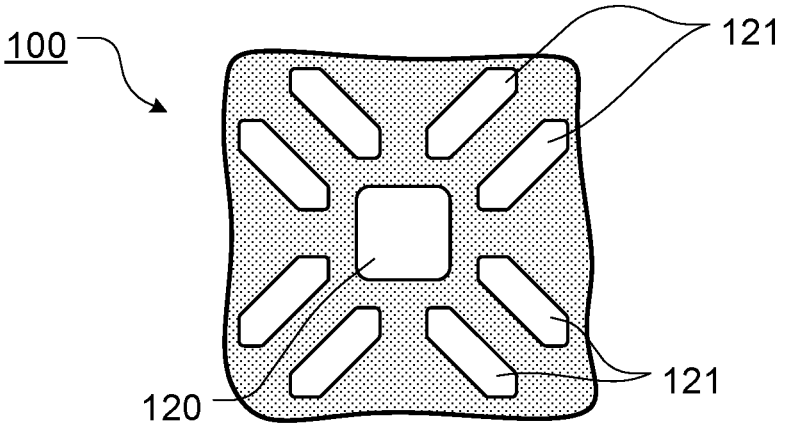
FIG. 28 illustrates an exemplary embodiment of a repeatable modular attachment matrix pattern, arranged according to an exemplary embodiment of the presently disclosed systems, methods, and/or apparatuses.
Figure 29:
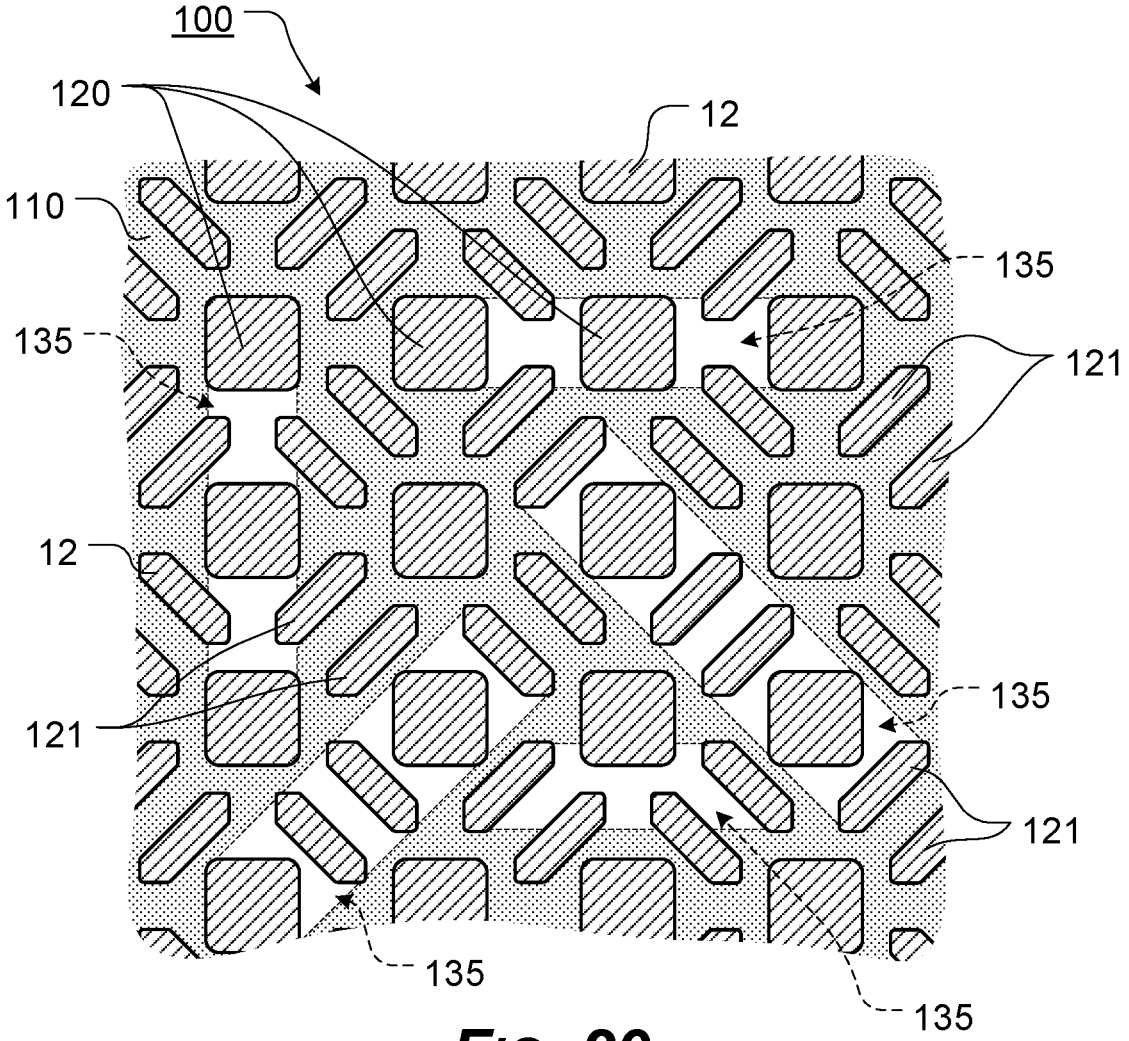
FIG. 29 illustrates the exemplary embodiment of the repeatable modular attachment matrix pattern of FIG. 28 repeated as part of a matrix layer, attached or coupled to a carrier material according to an exemplary embodiment of the presently disclosed systems, methods, and/or apparatuses.

In various exemplary embodiments, as illustrated in FIG. 4, the matrix apertures 120 are generally formed as apertures through the matrix layer 110. Each matrix aperture 120 is defined by one or more continuous edges. In various exemplary embodiments, each matrix aperture 120 may optionally be formed in the shape of an octagon. However, it should be appreciated that each of the matrix apertures 120 may generally be formed in the shape of a triangle, a square (as illustrated in FIGS. 28-29), a rectangle, a pentagon, a hexagon (as illustrated in FIG. 13), a heptagon, an octagon (as illustrated in FIGS. 15-24, 26-27, and 30-31), a nanogon, a decagon, a pentadecagon, an icosagon, a circle (as illustrated in FIG. 14), an oval, a dumbbell/barbell shape (as illustrated in FIG. 25), or any other desired shape or configuration. Thus, it should be appreciated that the size and shape of each of the matrix apertures 120 is a design choice based upon the desired functionality and/or appearance of the modular attachment matrix 100 and/or the matrix layer 110.

The size or diameter of each matrix aperture 120 is also a design choice. In certain exemplary embodiments, the size or diameter of each matrix aperture 120 is influenced or dictated by the width of the accessory coupling element of a compatible accessory, such as, for example, the accessory coupling element 88 of a compatible accessory 81. For example, if the accessory coupling element 88 has a width of approximately 1 inch, the size or diameter of each matrix aperture 120 may optionally be approximately 1 inch, so as to allow the accessory coupling element 88 to be fitted within and interwoven between two or more matrix apertures 120. Alternatively, the size or diameter of each matrix aperture 120 may be created such that only certain accessories are compatible with the matrix layer 110 and the modular attachment matrix 100.

The matrix apertures 120 are arranged in a repeating or semi-repeating series or sequence of spaced apart, repeating patterns. In various exemplary embodiments, the matrix apertures 120 are arranged in a repeating or semi-repeating series or sequence of spaced apart rows 113 and columns 112. In various exemplary embodiments, the matrix apertures 120 are arranged in a series of equally spaced rows 113 and equally spaced columns 112.

In certain exemplary embodiments, each of the rows 113 is spaced at a distance that is the same as the spacing between each of the columns 112. Alternatively, the spacing between each of the rows 113 is greater than or less than the spacing between each of the columns 112.

In various exemplary embodiments, the spacing between either edges or proximate centers of adjacent matrix apertures 120 (whether vertically, horizontally, obliquely, or diagonally adjacent) is influenced or dictated by the width of the accessory webbing element 83 of a compatible accessory 81. For example, if the accessory webbing element 83 has a width of approximately 1 inch, the spacing between either edges or proximate centers of adjacent matrix apertures 120 may optionally be approximately 1 inch, so as to allow the accessory webbing element(s) 83 to be appropriately aligned between every other matrix aperture 120 in a vertical, horizontal, oblique, or diagonal direction. Alternatively, the spacing between either edges or proximate centers of adjacent matrix apertures 120 may be created such that only certain accessories are compatible with the matrix layer 110 and the modular attachment matrix 100.

It should be appreciated that two or more adjacent matrix apertures 120 may comprise a row 113 and two or more adjacent matrix apertures 120 may comprise a column 112. Thus, it should be appreciated that the number of matrix apertures 120 formed in the matrix layer 110 is a design choice based upon the desired size and/or functionality of the matrix layer 110.

Figure 18:
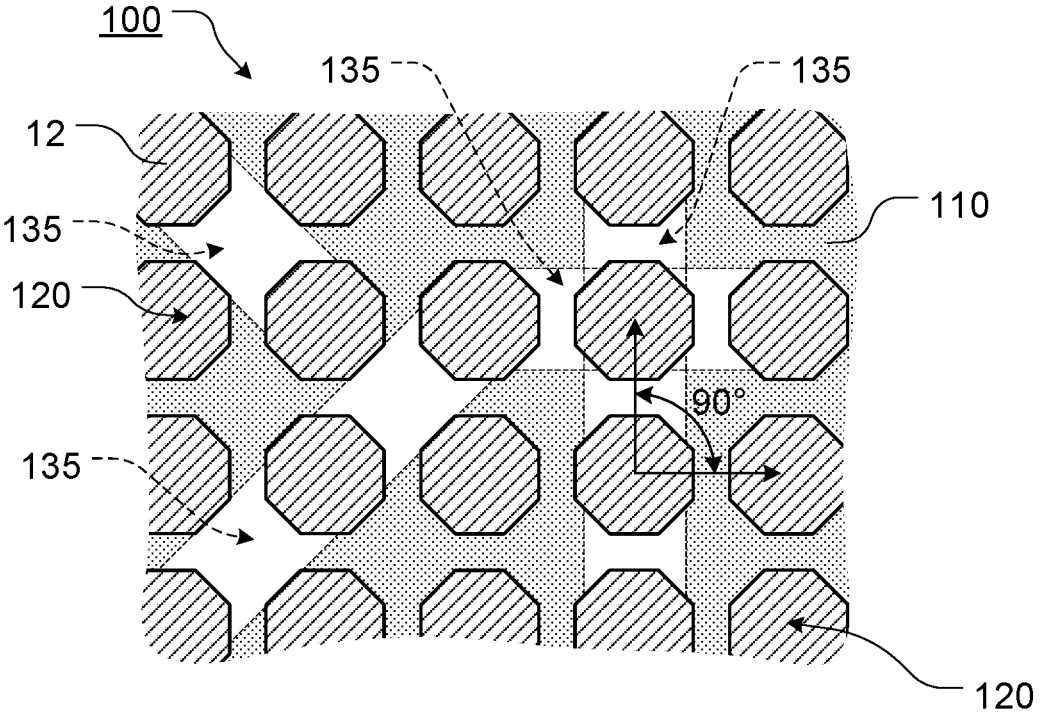
FIG. 18 illustrates an exemplary embodiment of the modular attachment matrix attached or coupled to a carrier material, wherein the modular attachment matrix comprises a plurality of substantially octagonally shaped matrix apertures, arranged according to an exemplary embodiment of the presently disclosed systems, methods, and/or apparatuses.

In various exemplary, nonlimiting embodiments, each adjacent row 113 and/or column 112 of spaced apart matrix apertures 120 is offset such that either edges or proximate centers of adjacent matrix apertures 120 are offset by approximately ±45° (as illustrated in FIG. 4) or approximately ±90° (as illustrated in FIG. 18). If for example, either edges or proximate centers of adjacent matrix apertures 120 are offset by ±45° or ±90°, an attached or coupled accessory 81 can be attached or coupled at least at ±0°, ±90°, or ±45°. Thus, it should be appreciated that the offset of adjacent rows 113 and/or columns 112 dictates the angle of oblique attachment of accessories.

In certain exemplary, nonlimiting embodiments, each matrix aperture 120 is separated from each other matrix aperture 120 by a distance that is equal to or greater than a width of each matrix aperture 120.

By arranging the matrix apertures 120 in a repeating or semi-repeating series or sequence, matrix tunnel segments 135 are created between adjacent matrix apertures 120 (whether vertically, horizontally, obliquely, or diagonally adjacent).

In certain exemplary embodiments, alternate attachment apertures 121 are optionally formed in portions of the matrix layer 110. For example, as illustrated, the alternate attachment apertures 121 may comprise apertures formed at spaced apart locations of the matrix layer 110. The alternate attachment apertures 121 may allow for alternate means of attachment between the matrix layer 110 and one or more desired accessories.

Figure 20:
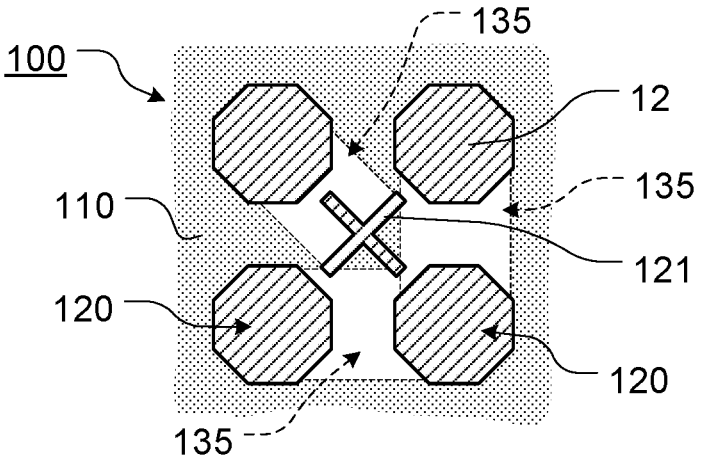
FIG. 20 illustrates an exemplary embodiment of the modular attachment matrix attached or coupled to a carrier material, wherein the modular attachment matrix comprises a plurality of substantially octagonally shaped matrix apertures and at least one alternate matrix aperture, arranged according to an exemplary embodiment of the presently disclosed systems, methods, and/or apparatuses.
Figure 21:
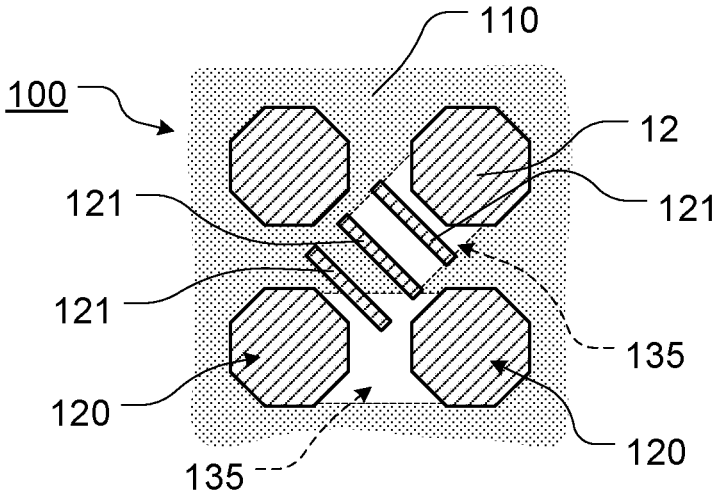
FIG. 21 illustrates an exemplary embodiment of the modular attachment matrix attached or coupled to a carrier material, wherein the modular attachment matrix comprises a plurality of substantially octagonally shaped matrix apertures and a plurality of alternate matrix apertures, arranged according to an exemplary embodiment of the presently disclosed systems, methods, and/or apparatuses.
Figure 22:
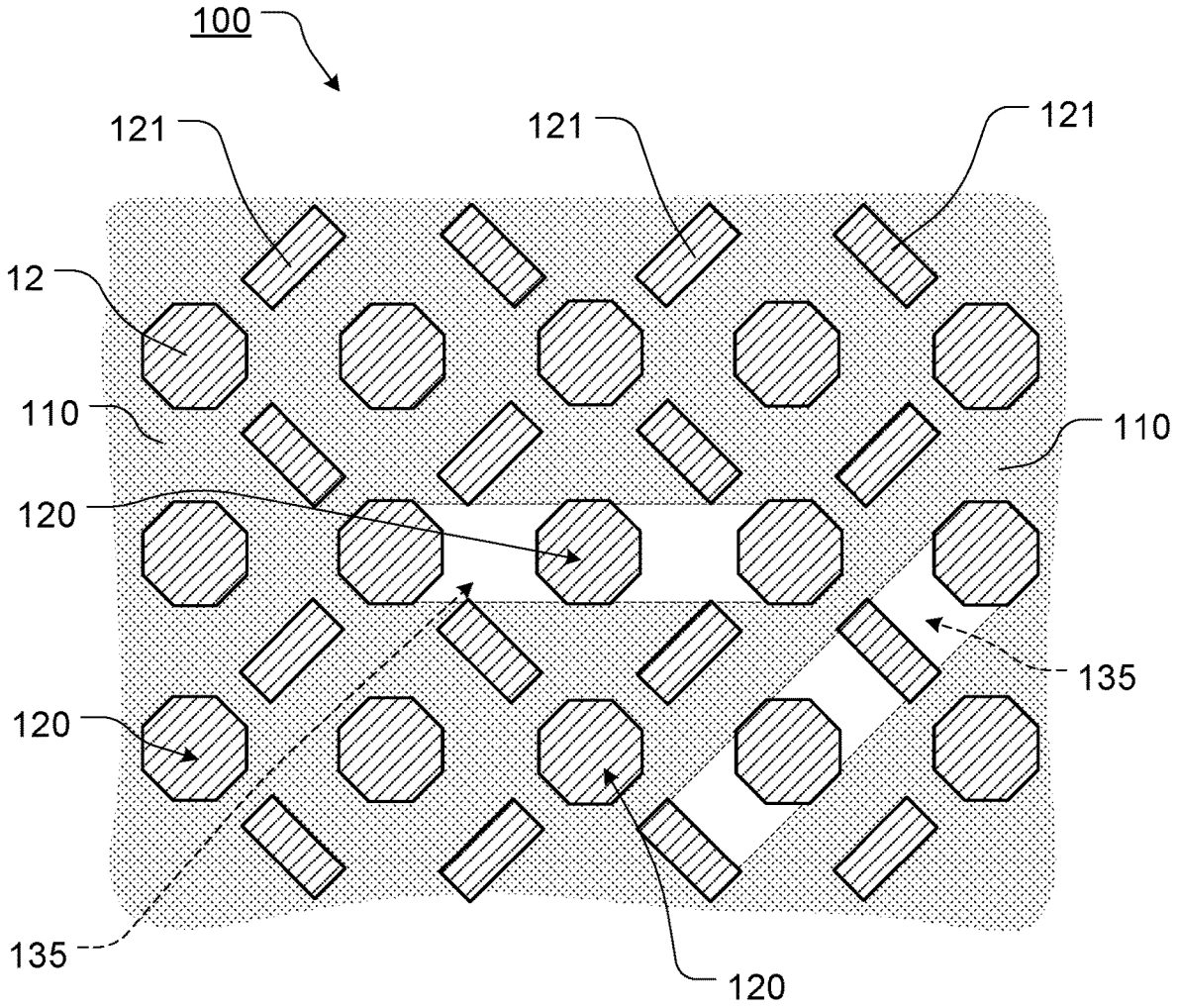
FIG. 22 illustrates an exemplary embodiment of the modular attachment matrix attached or coupled to a carrier material, wherein the modular attachment matrix comprises a plurality of substantially octagonally shaped matrix apertures and a plurality of alternate matrix apertures, arranged according to an exemplary embodiment of the presently disclosed systems, methods, and/or apparatuses.
Figure 23:
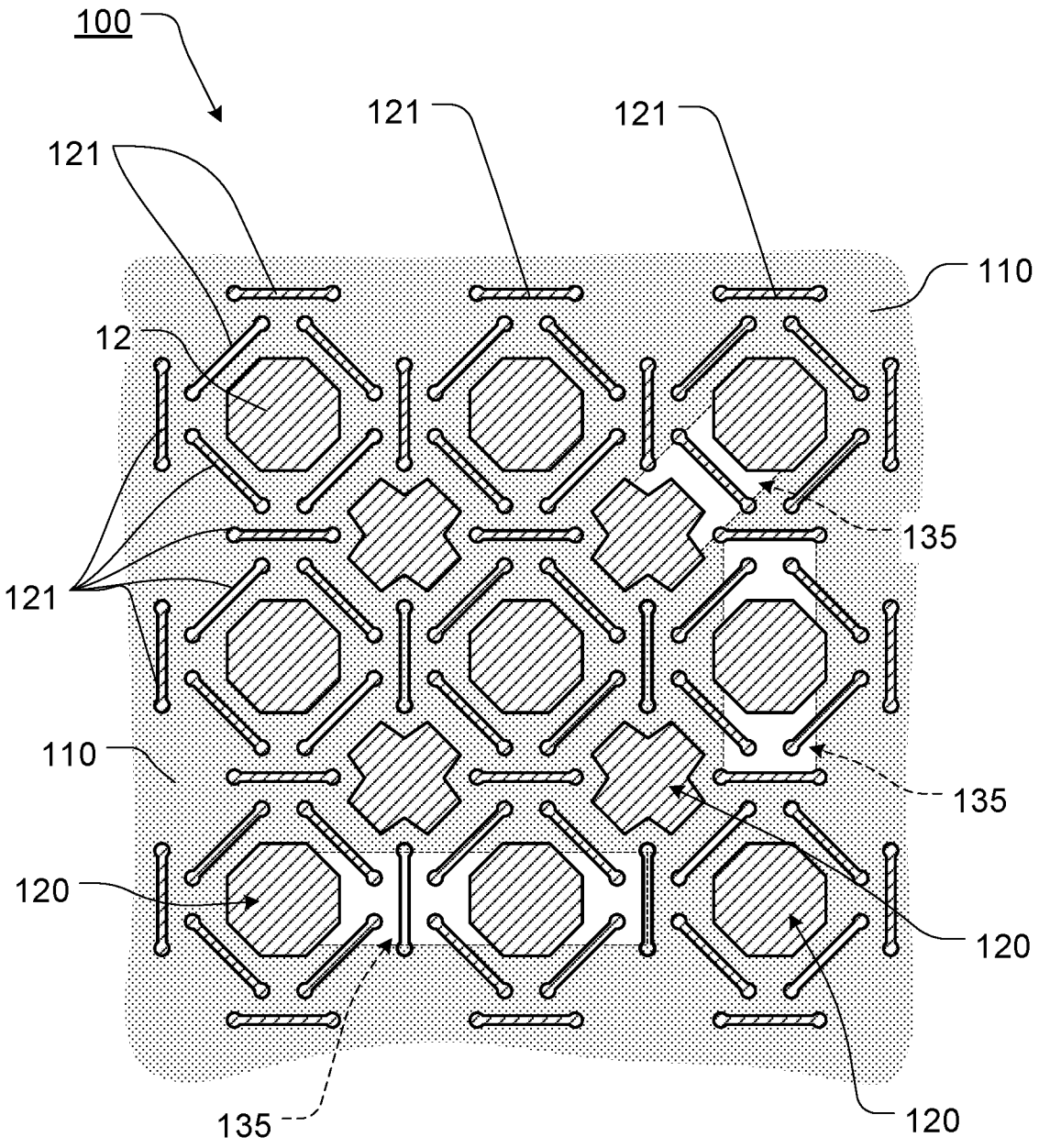
FIG. 23 illustrates an exemplary embodiment of the modular attachment matrix attached or coupled to a carrier material, wherein the modular attachment matrix comprises a plurality of substantially octagonally shaped matrix apertures and a plurality of alternate matrix apertures, arranged according to an exemplary embodiment of the presently disclosed systems, methods, and/or apparatuses.
Figure 26:
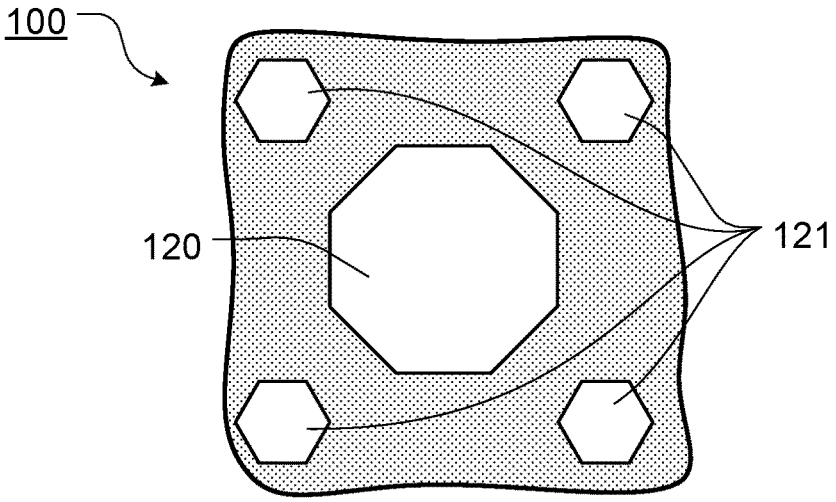
FIG. 26 illustrates an exemplary embodiment of a repeatable modular attachment matrix pattern, arranged according to an exemplary embodiment of the presently disclosed systems, methods, and/or apparatuses.

In various exemplary embodiments, the alternate attachment apertures 121 are generally formed in the shape of a circle (as illustrated in FIGS. 3-14). However, it should be appreciated that each of the alternate attachment apertures 121 may generally be formed in the shape of a triangle, a square, a rectangle (as illustrated in FIGS. 21-22), a pentagon, a hexagon (as illustrated in FIGS. 26-27), an elongate hexagon (as illustrated in FIGS. 28-31), a heptagon, an octagon, a nanogon, a decagon, a pentadecagon, an icosagon, an oval, a dumbbell/barbell shape (as illustrated in FIGS. 23-24), an "x" (as illustrated in FIG. 20), or any other desired shape or configuration. Thus, it should be appreciated that the size and shape of each of the alternate attachment apertures 121 is a design choice based upon the desired functionality and/or appearance of the modular attachment matrix 100 and/or the matrix layer 110.

It is possible for the matrix layer 110 to operate as a stand-alone element, such as, for example, a sheet of matrix layer 110 material, to which compatible accessories may be attached or coupled. However, in various exemplary embodiments, the matrix layer 110 is at least partially attached or coupled to at least a portion of a carrier or carrier material, such as, for example, a carrier material 12. Thus, the matrix layer 110 may be at least partially attached or coupled to an exemplary carrier (such as, for example, exemplary carrier material 12), for example, an article of clothing, a vest, a plate carrier, a backpack, a pack, a bag, a platform, or another flexible, semi-rigid, or rigid carrier.

As illustrated, for example, in FIGS. 3 and 5-12, the matrix layer 110 is illustrated as comprising a somewhat rectangular portion of matrix layer 110 material that is at least partially attached or coupled to an exemplary bag. As illustrated, the matrix layer 110 is attached or coupled to a portion of the exemplary bag by matrix layer attachment elements 130, such as stitching proximate a perimeter of the matrix layer 110. The matrix layer 110 may then optionally be further attached or coupled to the carrier material 12, via additional matrix layer attachment elements 130. The matrix layer attachment elements 130 are spaced apart, as necessary or desirable, in order to further secure, attach, or couple the matrix layer 110 to the carrier material 12. The number and placement of additional matrix layer attachment elements 130 is a design choice based upon the desired level of securement of the matrix layer 110 to the carrier material 12 and/or to further ensure that the matrix layer 110 will not separate or pull away from the carrier material 12, particularly if accessories are attached or coupled to the matrix layer 110.

In certain exemplary embodiments, the matrix layer attachment elements 130 comprise stitching. Alternatively, the matrix layer 110 may be attached or coupled to the carrier material 12 at one or more matrix layer attachment elements 130 via adhesive bonding, welding, screws, rivets, pins, mating hook and loop portions, snap or releasable fasteners, or other known or later developed means or methods for permanently or releasably attaching or coupling the matrix layer 110 to the carrier material 12. The one or more matrix layer attachment elements 130 may be formed or positioned proximate a perimeter of the matrix layer 110 or in one or more areas located within the one or more matrix layers 110.

In addition to the variability of size and shape of the matrix layer 110, the orientation of the matrix layer 110, relative to the carrier material 12, is also a design choice. Thus, as illustrated in FIGS. 3 and 5-12, the matrix layer 110 is illustrated as being attached or coupled to the carrier material 12, such that the rows 113 of matrix apertures 120 are substantially parallel to the longitudinal axis, along the length, of the exemplary bag, while the columns 112 of matrix apertures 120 are substantially perpendicular to the longitudinal axis of the exemplary bag. It should be appreciated that this is merely exemplary and the matrix layer 110 may be attached at any desired angular or rotational orientation relative to a surface of the bag or carrier material 12.

The portions of material of the matrix layer 110 between adjacent matrix apertures 120 form matrix tunnel segments 135. If the matrix layer 110 is attached to a carrier material 12, the matrix tunnel segments 135 are formed between the matrix layer 110 and the surface of the carrier material 12. The matrix tunnel segments 135 provide areas for securing the accessory coupling element 88 of an accessory 81 to the matrix layer 110. In this manner, an accessory coupling element 88 may be interwoven between the aligned matrix tunnel segments 135 to removably attach the accessory 81 to the carrier material 12.

Figure 7:
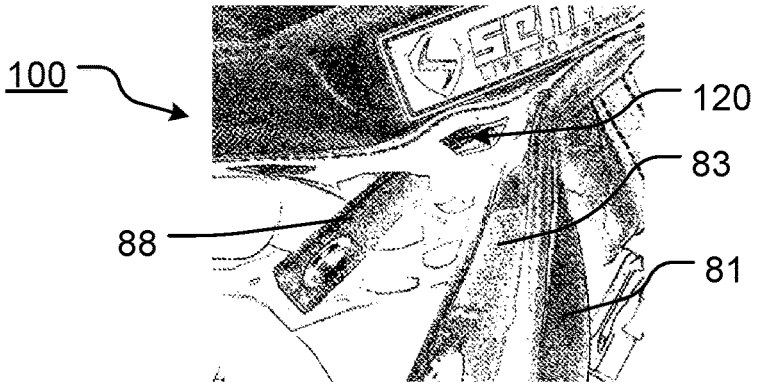
FIG. 7 illustrates a more detailed view of the interaction between the matrix layer of the modular attachment matrix and the accessory coupling element of an exemplary accessory, according to the presently disclosed systems, methods, and/or apparatuses.
Figure 8:
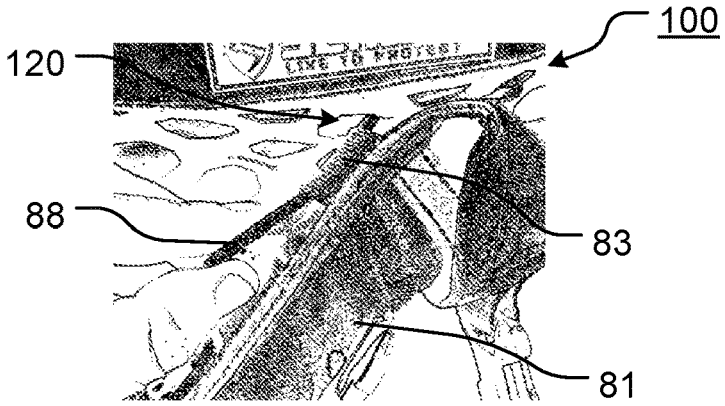
FIG. 8 illustrates a more detailed view of the interaction between the matrix layer of the modular attachment matrix, the accessory coupling element of an exemplary accessory, and the accessory webbing element of the exemplary accessory, according to the presently disclosed systems, methods, and/or apparatuses.
Figure 9:
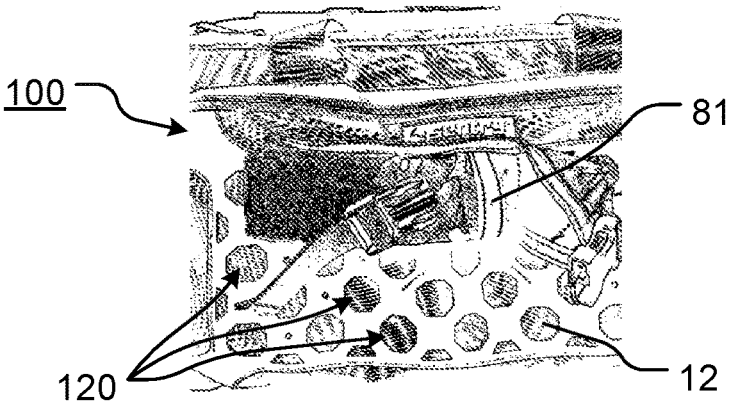
FIG. 9 illustrates an exemplary accessory attached or coupled to the matrix layer of the modular attachment matrix, according to the presently disclosed systems, methods, and/or apparatuses.
Figure 10:
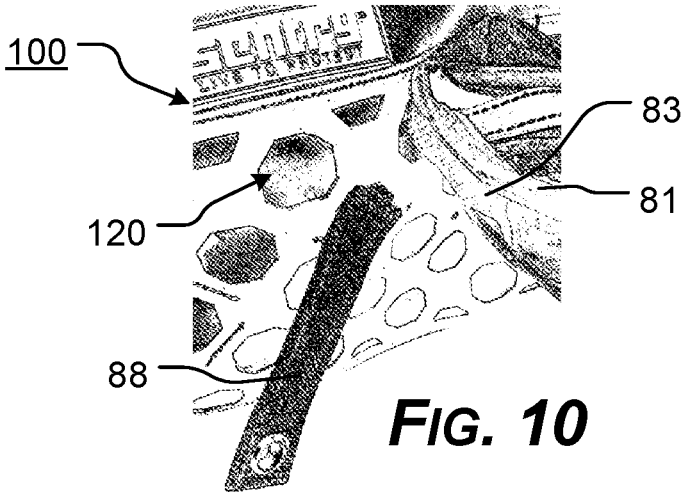
FIG. 10 illustrates a more detailed view of the interaction between the matrix layer of the modular attachment matrix and the accessory coupling element of an exemplary accessory, according to the presently disclosed systems, methods, and/or apparatuses.
Figure 11:
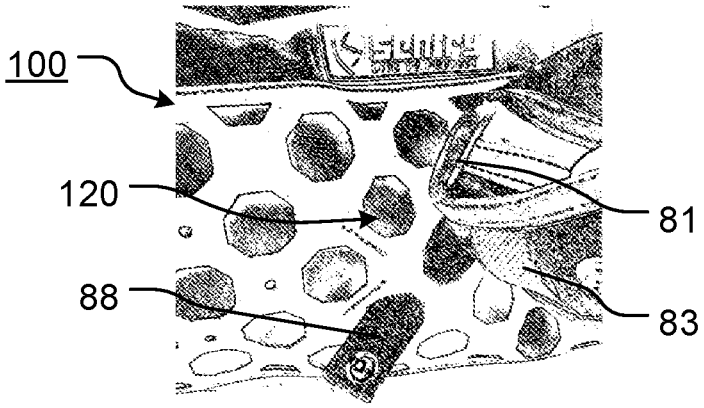
FIG. 11 illustrates a more detailed view of the interaction between the matrix layer of the modular attachment matrix and the accessory coupling element of an exemplary accessory, according to the presently disclosed systems, methods, and/or apparatuses.
Figure 12:
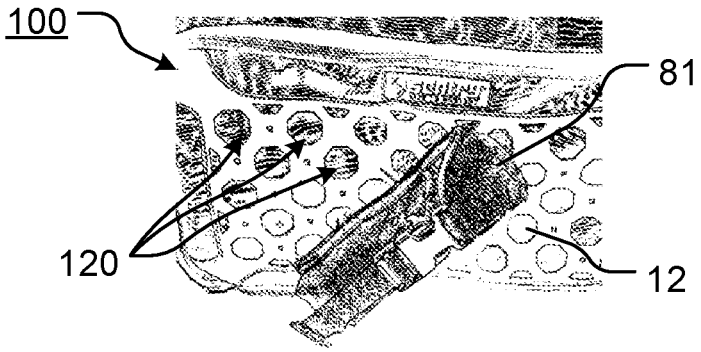
FIG. 12 illustrates an exemplary accessory attached or coupled to the matrix layer of the modular attachment matrix, according to the presently disclosed systems, methods, and/or apparatuses.

During attachment of an exemplary accessory 81, as illustrated most clearly in FIGS. 5-12, the accessory 81 is aligned with the matrix layer 110 in a desired orientation. As illustrated in FIGS. 5-12, the accessory 81 may optionally be aligned with the matrix layer 110 in a generally vertical manner, as illustrated in FIGS. 7-9, the accessory 81 may optionally be aligned with the matrix layer 110 in a generally horizontal manner, or as illustrated in FIGS. 10-12, the accessory 81 may optionally be aligned with the matrix layer 110 in a generally oblique or diagonal manner. It should be understood that these orientations are relative to the orientation of the matrix layer 110 and the orientation of the matrix layer 110 relative to the carrier material 12.

As further illustrated, the exemplary accessory 81 includes one or more substantially parallel, spaced apart accessory webbing elements 83. If more than one accessory webbing element 83 is included, the accessory webbing elements 83 are spaced apart so as to correspond to the spaces between the spaced apart matrix apertures 120.

When the accessory 81 is placed adjacent the matrix layer 110 such that at least a portion of the accessory webbing elements 83 are within a portion of the spaces between the spaced apart matrix apertures 120 (and at least a portion of the matrix apertures 120 are within the spaces between the spaced apart accessory webbing elements 83) and corresponding matrix tunnel segments 135 and accessory tunnel segments 87 are aligned, the accessory coupling element 88 may be interwoven between the aligned matrix tunnel segments 135 and accessory tunnel segments 87 (alternating between adjacent matrix apertures 120 and/or alternate attachment apertures 121 of the matrix layer 110 and accessory webbing elements 83 on the accessory 81) to removably attach the accessory 81 to the matrix layer 110.

Thus, an accessory 81 may be mounted to the matrix layer 110 in a variety of orientations. Likewise, if a particular carrier material 12 includes a matrix layer 110, a variety of accessories may be interchangeably mounted to the matrix layer 110 to accommodate a variety of desired configurations.

It should be appreciated that a more detailed explanation of the instructions regarding how to interweave the accessory coupling element 88 between the matrix apertures 120 and accessory webbing elements 83 is not provided herein because, while the matrix layer 110 provides more orientation options and other features, accessories are generally attached to the matrix layer 110 in a manner similar to the manner in which accessories are attached to a portion of MOLLE webbing. Therefore, it is believed that the level of description provided herein is sufficient to enable one of ordinary skill in the art to understand and practice the systems, methods, and apparatuses, as described.

FIGS. 13-31 illustrate various exemplary embodiments of a matrix layer 110 and a modular attachment matrix 100, according to the present disclosure. As illustrated, the modular attachment matrix 100 includes a matrix layer 110 having two or more matrix apertures 120 formed therethrough at spaced apart locations and arranged in one or more rows 113 and/or columns 112. The matrix layer 110 is at least partially attached or coupled to a carrier material 12 and tunnel segments 135 are formed between adjacent matrix apertures 120. Additional, optional alternate attachment apertures 121 are also formed in the matrix layer 110.

It should be understood that each of these elements corresponds to and operates similarly to the modular attachment matrix 100, matrix layer 110, matrix apertures 120, tunnel segments 135, and alternate attachment apertures 121, as described above with reference to the modular attachment matrix 100 of FIGS. 3-12.

However, FIG. 13 illustrates an exemplary embodiment of the modular attachment matrix 100, wherein the modular attachment matrix 100 comprises substantially hexagonally shaped matrix apertures 120, while FIG. 14 illustrates an exemplary embodiment of the modular attachment matrix 100, wherein the modular attachment matrix 100 comprises substantially circular shaped matrix apertures 120.

Figure 15:
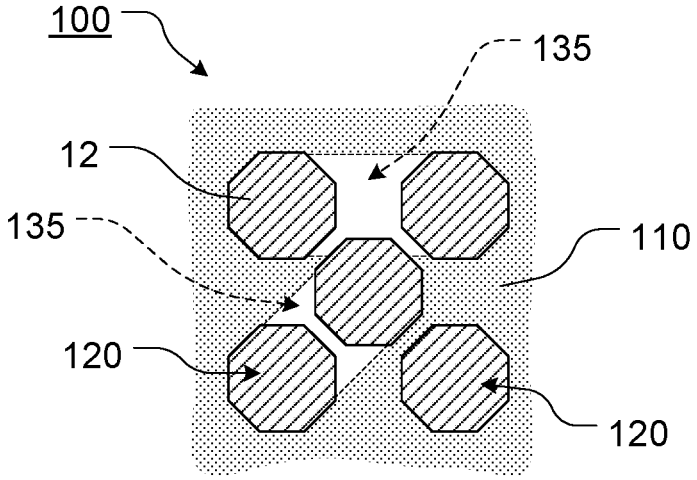
FIG. 15 illustrates an exemplary embodiment of the modular attachment matrix attached or coupled to a carrier material, wherein the modular attachment matrix comprises substantially octagonally shaped matrix apertures, arranged according to an exemplary embodiment of the presently disclosed systems, methods, and/or apparatuses.
Figure 16:
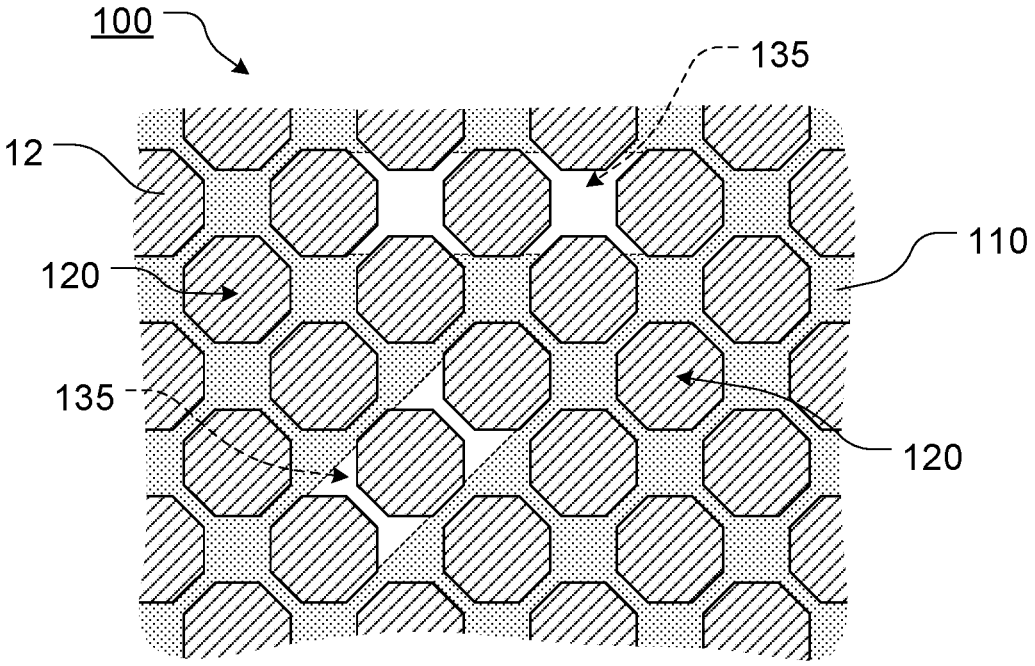
FIG. 16 illustrates an exemplary embodiment of the modular attachment matrix attached or coupled to a carrier material, wherein the modular attachment matrix comprises a plurality of substantially octagonally shaped matrix apertures, arranged according to an exemplary embodiment of the presently disclosed systems, methods, and/or apparatuses.

FIG. 15 illustrates an exemplary embodiment of the modular attachment matrix 100 attached or coupled to a carrier material 12. As illustrated, the modular attachment matrix 100 comprises five substantially octagonally shaped matrix apertures 120, arranged or grouped such that exemplary tunnel segments 135 are formed in a relatively horizontal, relatively vertical, and relatively diagonal manner. FIG. 16 illustrates an exemplary embodiment of the modular attachment matrix 100 attached or coupled to a carrier material 12, wherein the modular attachment matrix 100 comprises a plurality of substantially octagonally shaped matrix apertures 120, as illustrated in FIG. 15. However, as illustrated in FIG. 16, the grouping of five matrix apertures 120 is expanded to a plurality of arranged matrix apertures 120. Therefore, it should be appreciated that the total number of matrix apertures 120 used to form the modular attachment matrix 100 of the matrix layer 110 is a design choice, based upon the desired area that the modular attachment matrix 100 is to cover, whether attached to a carrier material 12 or as a standalone matrix layer 110.

Figure 17:
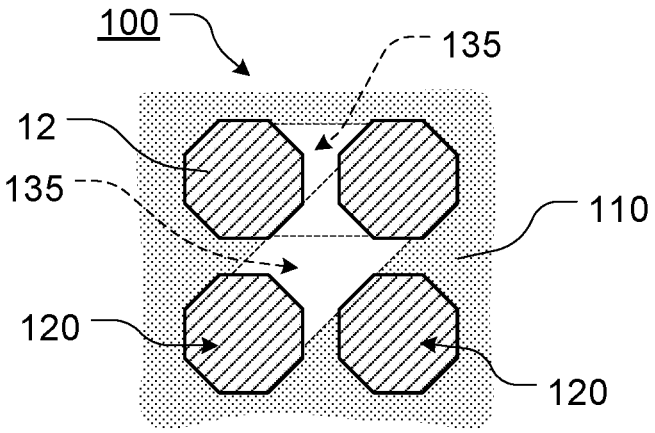
FIG. 17 illustrates an exemplary embodiment of the modular attachment matrix attached or coupled to a carrier material, wherein the modular attachment matrix comprises a plurality of substantially octagonally shaped matrix apertures, arranged according to an exemplary embodiment of the presently disclosed systems, methods, and/or apparatuses.

FIG. 17 illustrates an exemplary embodiment of the modular attachment matrix 100 attached or coupled to a carrier material 12, wherein the modular attachment matrix 100 comprises four, spaced apart, substantially octagonally shaped matrix apertures 120. As illustrated, the positioning of the matrix apertures 120 still provides relatively horizontal, relatively vertical, and relatively diagonal tunnel segments 135. It should be appreciated that the arrangement or grouping of matrix apertures 120, as illustrated in FIG. 17, may be duplicated to create a matrix layer 110 of any desired size and including any number of desired matrix apertures 120, as illustrated, for example, in FIG. 18.

Figure 19:
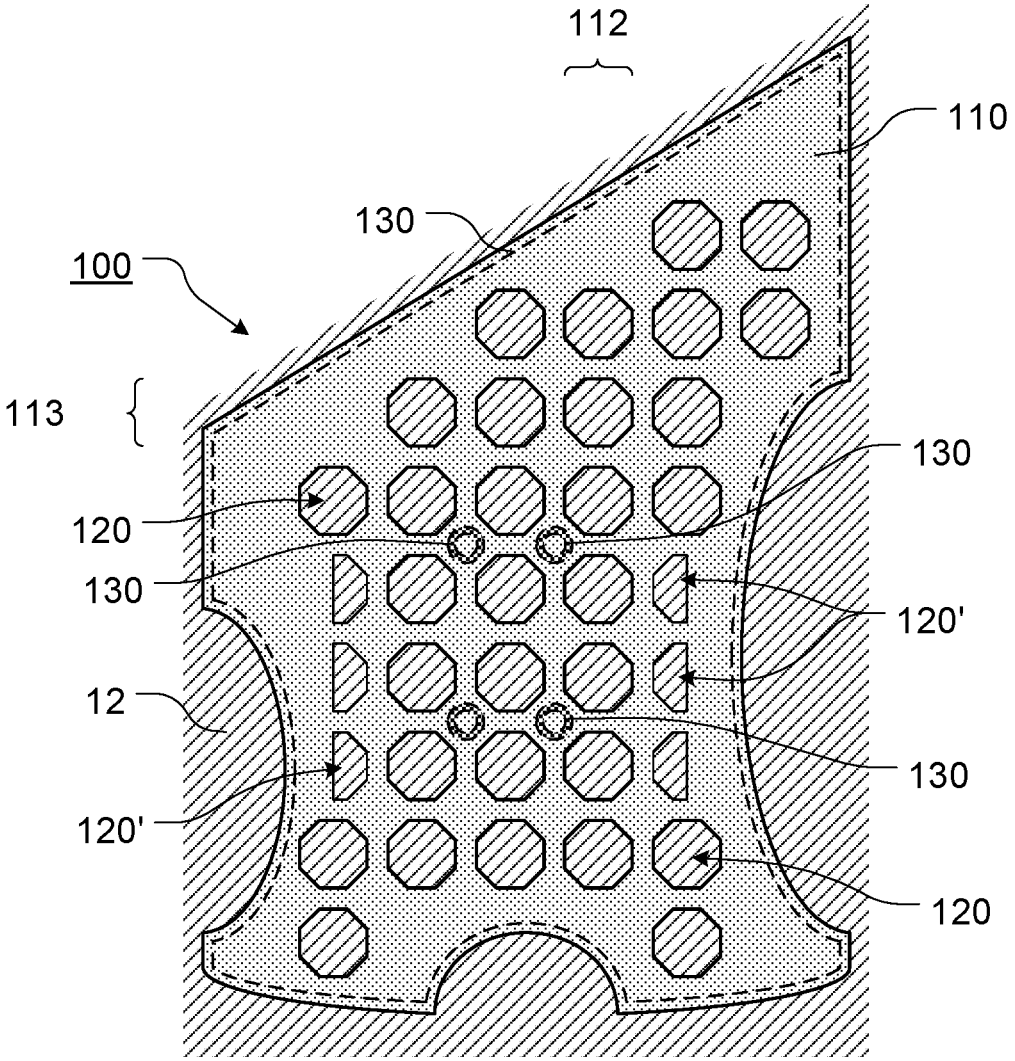
FIG. 19 illustrates an exemplary embodiment of a portion of the modular attachment matrix attached or coupled to an exemplary carrier material, wherein the modular attachment matrix comprises a plurality of substantially octagonally shaped matrix apertures, arranged according to an exemplary embodiment of the presently disclosed systems, methods, and/or apparatuses.

As further illustrated in FIG. 19, the arrangement or grouping of matrix apertures 120 may be applied to the matrix layer 110 in any desired arrangement. For example, while the matrix apertures 120 are arranged in a repeating or semi-repeating series or sequence of equally spaced rows 113 and equally spaced columns 112, the length of each row 113 or column 112 may be varied to produce a desired arrangement of matrix apertures 120.

As further illustrated in FIG. 19, the arrangement or grouping of matrix apertures 120 includes a number of partial matrix apertures 120'. Each partial matrix aperture 120' is formed of a partial or incomplete matrix aperture. While the partial matrix apertures 120' are each illustrated as being positioned at a beginning or end of a given row 113, it should be appreciated that partial matrix apertures 120' may optionally be included at a beginning or an end of one or more rows 113, one or more columns 112, or within a given row 113 or column 112.

FIG. 20 illustrates an exemplary embodiment of the modular attachment matrix 100 attached or coupled to a carrier material 12, wherein the modular attachment matrix 100 comprises four, spaced apart, substantially octagonally shaped matrix apertures 120 and at least one alternate matrix aperture 121 formed in a relative center of the grouping of four matrix apertures 120. As illustrated, the alternate matrix aperture 121 comprises a substantially "X" or "+" shaped aperture. By utilizing such an alternate matrix aperture 121, diagonal tunnel segments 135 may be formed between diagonally positioned matrix apertures 120, diagonally positioned alternate matrix apertures 121, and diagonally positioned matrix apertures 120 and alternate matrix apertures 121. Depending upon the flexibility of the matrix layer 110, tunnel segments 135, such as the exemplary tunnel segments 135 illustrated, may be joined and utilized between horizontally, vertically, or diagonally positioned alternate matrix apertures 121 and/or matrix apertures 120.

It should be appreciated that the arrangement or grouping of four matrix apertures 120 and a substantially "X" or "+" shaped alternate matrix aperture 121, as illustrated in FIG. 20, may be duplicated to create a matrix layer 110 of any desired size and including any number of desired matrix apertures 120 and alternate matrix apertures 121.

FIG. 21 illustrates an exemplary embodiment of the modular attachment matrix 100 attached or coupled to a carrier material 12, wherein the modular attachment matrix 100 comprises four, spaced apart, substantially octagonally shaped matrix apertures 120 and a plurality of alternate matrix apertures 121 formed in a relative center of the grouping of four matrix apertures 120. As illustrated, the alternate matrix apertures 121 comprise a series of parallel slots, formed through the matrix layer 110. By utilizing such a series of alternate matrix apertures 121, diagonal tunnel segments 135 may be formed between diagonally positioned matrix apertures 120, diagonally positioned alternate matrix apertures 121, and diagonally positioned matrix apertures 120 and alternate matrix apertures 121. Tunnel segments 135, such as the exemplary tunnel segments 135 illustrated, may be joined and utilized between horizontally, vertically, or diagonally positioned alternate matrix apertures 121 and/or matrix apertures 120.

It should be appreciated that the arrangement or grouping of four matrix apertures 120 and a plurality of alternate matrix apertures 121 formed in a relative center of the grouping of four matrix apertures 120, as illustrated in FIG. 21, may be duplicated to create a matrix layer 110 of any desired size and including any number of desired matrix apertures 120 and alternate matrix apertures 121.

FIG. 22 illustrates an exemplary embodiment of the modular attachment matrix 100 attached or coupled to a carrier material 12, wherein the modular attachment matrix 100 comprises a plurality of spaced apart, substantially octagonally shaped matrix apertures 120 and a plurality of alternate matrix apertures 121 formed in a repeating "X" or zigzag pattern relative to the spaced apart matrix apertures 120. As illustrated, the alternate matrix apertures 121 comprise a series of diagonally alternating slots, formed through the matrix layer 110. By utilizing such a series of diagonally alternating alternate matrix apertures 121, diagonal tunnel segments 135 may be formed between diagonally positioned matrix apertures 120, diagonally positioned alternate matrix apertures 121, and diagonally positioned matrix apertures 120 and alternate matrix apertures 121. Tunnel segments 135, such as the exemplary tunnel segments 135 illustrated, may be joined and utilized between horizontally, vertically, or diagonally positioned alternate matrix apertures 121 and/or matrix apertures 120.

It should be appreciated that the arrangement or grouping of matrix apertures 120 and diagonally alternating alternate matrix apertures 121, as illustrated in FIG. 22, may be duplicated to create a matrix layer 110 of any desired size and including any number of desired matrix apertures 120 and alternate matrix apertures 121.

FIG. 23 illustrates an exemplary embodiment of the modular attachment matrix 100 attached or coupled to a carrier material 12, wherein the modular attachment matrix 100 comprises a plurality of spaced apart, substantially octagonally shaped matrix apertures 120, a plurality of "X or "+" shaped matrix apertures 120', and a plurality of horizontal, vertical, and diagonal slot or dumbbell/barbell shaped alternate matrix apertures 121 formed in a repeating pattern. By utilizing such a repeated series of alternating substantially octagonally shaped matrix apertures 120, "X or "+" shaped matrix apertures 120', and slot or dumbbell/barbell shaped alternate matrix apertures 121, tunnel segments 135, such as the exemplary tunnel segments 135 illustrated, may be joined and utilized between horizontally, vertically, or diagonally positioned matrix apertures 120.

It should be appreciated that the arrangement or grouping of substantially octagonally shaped matrix apertures 120, "X or "+" shaped matrix apertures 120', and slot or dumbbell/barbell shaped alternate matrix apertures 121, as illustrated in FIG. 23, may be duplicated to create a matrix layer 110 of any desired size and including any number of desired matrix apertures 120 and alternate matrix apertures 121.

FIG. 24 illustrates an exemplary embodiment of the modular attachment matrix 100 attached or coupled to a carrier material 12, wherein the modular attachment matrix 100 comprises a plurality of spaced apart, substantially octagonally shaped matrix apertures 120 and a plurality of horizontal, vertical, and diagonal slot or dumbbell/barbell shaped alternate matrix apertures 121 formed in a repeating pattern. By utilizing such a repeated series of alternating substantially octagonally shaped matrix apertures 120 and slot or dumbbell/barbell shaped alternate matrix apertures 121, tunnel segments 135, such as the exemplary tunnel segments 135 illustrated, may be joined and utilized between horizontally, vertically, or diagonally positioned matrix apertures 120.

It should be appreciated that the arrangement or grouping of substantially octagonally shaped matrix apertures 120 and slot or dumbbell/barbell shaped alternate matrix apertures 121, as illustrated in FIG. 24, may be duplicated to create a matrix layer 110 of any desired size and including any number of desired matrix apertures 120 and alternate matrix apertures 121.

FIG. 25 illustrates an exemplary embodiment of the modular attachment matrix 100 attached or coupled to a carrier material 12, wherein the modular attachment matrix 100 comprises a plurality of spaced apart horizontal, vertical, and diagonal slot or dumbbell/barbell shaped matrix apertures 120 formed in a repeating pattern. By utilizing such a repeated series of alternating substantially slot or dumbbell/barbell shaped matrix apertures 120, tunnel segments 135, such as the exemplary tunnel segments 135 illustrated, may be joined and utilized between horizontally, vertically, or diagonally positioned matrix apertures 120.

It should be appreciated that the arrangement or grouping of slot or dumbbell/barbell shaped matrix apertures 120, as illustrated in FIG. 25, may be duplicated to create a matrix layer 110 of any desired size and including any number of desired matrix apertures 120 and alternate matrix apertures 121.

FIG. 26 illustrates an exemplary embodiment of a repeatable modular attachment matrix 100 pattern and FIG. 27 illustrates the exemplary embodiment of the repeatable modular attachment matrix 100 pattern of FIG. 26 repeated as part of a matrix layer 110, attached or coupled to a carrier material 12.

As illustrated in FIGS. 26 and 27, the exemplary modular attachment matrix 100 comprises a repeatable pattern including an octagonally shaped matrix aperture 120 associated with a plurality of substantially hexagonally shaped alternate matrix apertures 121. As illustrated, the octagonally shaped matrix aperture 120 is positioned substantially central to four hexagonally shaped alternate matrix apertures 121. Each of the hexagonally shaped alternate matrix apertures 121 is offset an equal distance from the substantially centrally positioned octagonally shaped matrix aperture 120.

In various exemplary, nonlimiting embodiments, a hexagonally shaped alternate matrix aperture 121 is formed at 45°, 135°, 225°, and 315° from the substantially centrally positioned octagonally shaped matrix aperture 120.

The octagonally and hexagonally shaped matrix apertures 120 and alternate matrix apertures 121 are merely exemplary and alternate shapes may be utilized to form the matrix apertures 120 and alternate matrix apertures 121.

FIG. 27 illustrates the exemplary embodiment of the repeatable modular attachment matrix 100 pattern of FIG. 26 repeated, in a repeating fashion, as part of a matrix layer 110, attached or coupled to a carrier material 12 according to an exemplary embodiment of the presently disclosed systems, methods, and/or apparatuses. As illustrated in FIG. 27, the repeatable pattern is repeated so that certain of the alternate matrix apertures 121 overlap one another to form the matrix pattern in the matrix layer 110. It should be appreciated that the total number of matrix apertures 120 and alternate matrix apertures 121 used to form the modular attachment matrix 100 of the matrix layer 110 is a design choice, based upon the desired area that the modular attachment matrix 100 is to cover, whether attached to a carrier material 12 or as a standalone matrix layer 110.

In various exemplary, nonlimiting embodiments, the matrix layer 110 is attached or coupled to a portion of the carrier material 12 by stitching proximate a perimeter of the matrix layer 110. The matrix layer 110 may then optionally be further attached or coupled to the carrier material 12, via additional matrix layer attachment elements 130. The matrix layer attachment elements 130 are spaced apart, as necessary or desirable, in order to further secure, attach, or couple the matrix layer 110 to the carrier material 12. The number and placement of additional matrix layer attachment elements 130 is a design choice based upon the desired level of securement of the matrix layer 110 to the carrier material 12 and/or to further ensure that the matrix layer 110 will not separate or pull away from the carrier material 12, particularly if accessories are attached or coupled to the matrix layer 110.

In certain exemplary embodiments, the matrix layer attachment elements 130 comprise stitching. Alternatively, the matrix layer 110 may be attached or coupled to the carrier material 12 (either proximate a perimeter or at matrix layer attachment elements 130) via stitching, adhesive bonding, welding, screws, rivets, pins, mating hook and loop portions, snap or releasable fasteners, or other known or later developed means or methods for permanently or releasably attaching or coupling the matrix layer 110 to the carrier material 12.

In addition to the variability of size and shape of the matrix layer 110, the orientation of the matrix layer 110, relative to the carrier material 12, is also a design choice. Thus, it should be appreciated that the matrix layer 110 may be attached at any desired angular or rotational orientation relative to a surface of the carrier material 12.

Portions of material of the matrix layer 110 between matrix apertures 120 and/or alternate matrix apertures 121 form matrix tunnel segments 135. If the matrix layer 110 is attached to a carrier material 12, the matrix tunnel segments 135 are formed between the matrix layer 110 and the surface of the carrier material 12. The matrix tunnel segments 135 provide areas for securing the accessory coupling element 88 of an accessory 81 to the matrix layer 110. In this manner, an accessory coupling element 88 may be interwoven between the aligned matrix tunnel segments 135 to removably attach the accessory 81 to the carrier material 12.

It should be appreciated that the length of each tunnel segment 135 is dictated by the size and shape of the matrix layer 110 and the distance between matrix apertures 120 and/or alternate matrix apertures 121.

It should also be understood that tunnel segments 135 may be formed between matrix apertures 120, between alternate matrix apertures 121, or between matrix apertures 120 and alternate matrix apertures 121.

During attachment of an exemplary accessory 81, as described herein, the accessory 81 is aligned with the matrix layer 110 in a desired orientation. As illustrated by the exemplary tunnel segments 135, the accessory 81 may optionally be aligned with the matrix layer 110 in a generally vertical manner, in a generally horizontal manner, or in a generally oblique or diagonal manner. It should be understood that these orientations are relative to the orientation of the matrix layer 110 and the orientation of the matrix layer 110 relative to the carrier material 12.

Thus, an accessory 81 may be mounted to the matrix layer 110 between matrix apertures 120, alternate matrix apertures 121, or matrix apertures 120 and alternate matrix apertures 121, in a variety of orientations.

It should be appreciated that a more detailed explanation of the instructions regarding how to interweave the accessory coupling element 88 between the matrix apertures 120, alternate matrix apertures 121, and accessory webbing elements 83 is not provided herein because it is believed that the level of description provided herein is sufficient to enable one of ordinary skill in the art to understand and practice the systems, methods, and apparatuses, as described.

FIG. 28 illustrates an exemplary embodiment of a repeatable modular attachment matrix 100 pattern and FIG. 29 illustrates the exemplary embodiment of the repeatable modular attachment matrix 100 pattern of FIG. 28 repeated as part of a matrix layer 110, attached or coupled to a carrier material 12.

As illustrated in FIGS. 28 and 29, the exemplary modular attachment matrix 100 comprises a repeatable pattern including one or more substantially square or rounded square shaped matrix apertures 120 associated with a plurality of substantially elongate alternate matrix apertures 121. As illustrated, a substantially square shaped matrix aperture 120 is positioned substantially central to eight substantially elongate alternate matrix apertures 121. Each of the substantially elongate alternate matrix apertures 121 is offset an equal distance from the substantially centrally positioned substantially square shaped matrix aperture 120.

In certain exemplary embodiments, additional substantially square shaped matrix apertures 120 are formed equal distance from the substantially centrally positioned substantially square shaped matrix aperture 120. In certain exemplary, nonlimiting embodiments, the additional substantially square shaped matrix apertures 120 are formed at 0°, 90°, 180°, and 270° relative to the substantially centrally positioned substantially square shaped matrix aperture 120.

As illustrated, the substantially elongate alternate matrix apertures 121 are formed in parallel pairs and extend at 45°, 135°, 225°, and 315° from the substantially centrally positioned substantially square shaped matrix aperture 120. It should be appreciated that the substantially elongate alternate matrix apertures 121 may be formed as a single alternate aperture, in parallel pairs, or in a plurality of parallel substantially elongate alternate matrix apertures 121.

The substantially square shaped matrix apertures 120 and substantially elongate alternate matrix apertures 121 are merely exemplary and alternate shapes may be utilized to form the substantially square shaped matrix apertures 120 and substantially elongate alternate matrix apertures 121.

FIG. 29 illustrates the exemplary embodiment of the repeatable modular attachment matrix 100 pattern of FIG. 28 repeated, in a repeating fashion, as part of a matrix layer 110, attached or coupled to a carrier material 12 according to an exemplary embodiment of the presently disclosed systems, methods, and/or apparatuses. As illustrated in FIG. 29, the repeatable pattern is repeated so that certain of the substantially elongate alternate matrix apertures 121 overlap one another to form the matrix pattern in the matrix layer 110. It should be appreciated that the total number of substantially square shaped matrix apertures 120 and substantially elongate alternate matrix apertures 121 used to form the modular attachment matrix 100 of the matrix layer 110 is a design choice, based upon the desired area that the modular attachment matrix 100 is to cover, whether attached to a carrier material 12 or as a standalone matrix layer 110.

Figure 30:
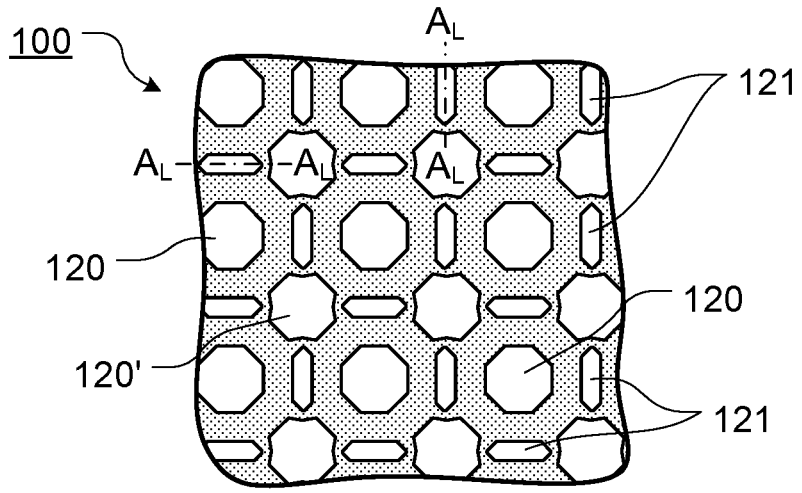
FIG. 30 illustrates an exemplary embodiment of the modular attachment matrix attached or coupled to a carrier material, wherein the modular attachment matrix comprises a plurality of substantially octagonally shaped matrix apertures, a plurality of substantially "X" or "+" shaped matrix apertures, and a plurality of alternate matrix apertures, arranged according to an exemplary embodiment of the presently disclosed systems, methods, and/or apparatuses.
Figure 31:
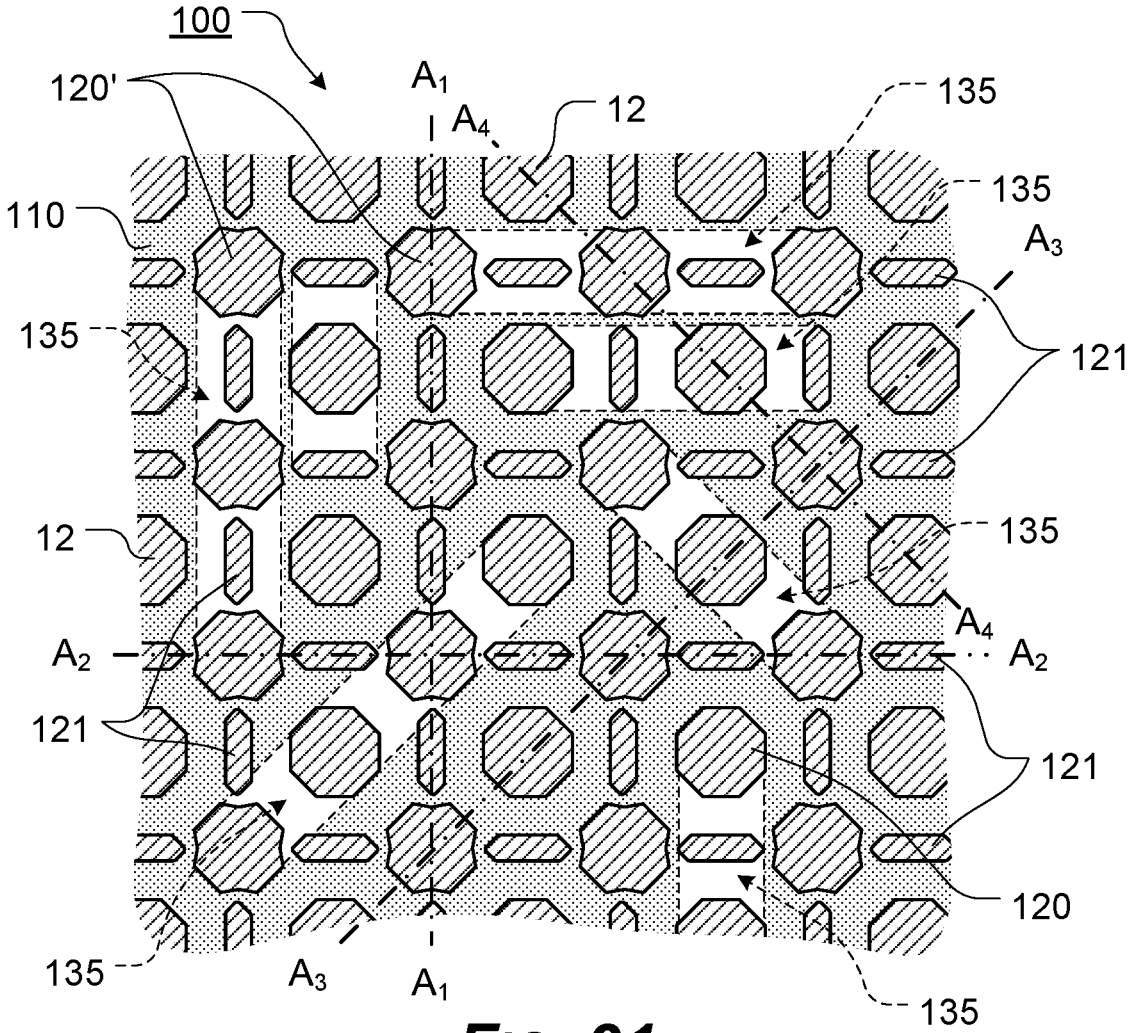
FIG. 31 illustrates an exemplary embodiment of the modular attachment matrix attached or coupled to a carrier material, wherein the modular attachment matrix comprises a plurality of substantially octagonally shaped matrix apertures, a plurality of substantially "X" or "+" shaped matrix apertures, and a plurality of alternate matrix apertures, arranged according to an exemplary embodiment of the presently disclosed systems, methods, and/or apparatuses.

As illustrated in FIGS. 30 and 31, the exemplary modular attachment matrix 100 comprises a repeatable pattern including a plurality of substantially octagonally shaped matrix apertures 120, a plurality of substantially "X" or "+" shaped matrix apertures 120', and a plurality of alternate matrix apertures 121, arranged according to an exemplary embodiment of the presently disclosed systems, methods, and/or apparatuses. As further illustrated, the substantially octagonally shaped matrix apertures 120 are arranged at spaced apart locations from one another substantially along or substantially in parallel to a first exemplary axis, $A_1$. In various exemplary embodiments, the substantially octagonally shaped matrix apertures 120 are arranged at equally spaced apart locations substantially along or substantially in parallel to the first exemplary axis, $A_1$.

The substantially octagonally shaped matrix apertures 120 are also arranged at spaced apart locations substantially along or substantially in parallel to a second exemplary axis, $A_2$. In various exemplary embodiments, the substantially octagonally shaped matrix apertures 120 are arranged at equally spaced apart locations substantially along or substantially in parallel to the second exemplary axis, $A_2$.

Each of the plurality of alternate matrix apertures 121 is formed by an elongate slot. An alternate matrix aperture 121 is formed between each substantially octagonally shaped matrix aperture 120. In various exemplary embodiments, as illustrated, the longitudinal axis, $A_L$, of each elongate slot is arranged so as to be substantially in parallel with the axis, $A_1$ or $A_2$, along which the substantially octagonally shaped matrix apertures 120 are arranged.

In a similar fashion, the substantially "X" or "+" shaped matrix apertures 120' are arranged at spaced apart locations from one another substantially along or substantially in parallel to a first exemplary axis, $A_1$. In various exemplary embodiments, the substantially "X" or "+" shaped matrix apertures 120' are arranged at equally spaced apart locations substantially along or substantially in parallel to the first exemplary axis, $A_1$.

The substantially "X" or "+" shaped matrix apertures 120' are also arranged at spaced apart locations substantially along or substantially in parallel to a second exemplary axis, $A_2$. In various exemplary embodiments, the substantially "X" or "+" shaped matrix apertures 120' are arranged at equally spaced apart locations substantially along or substantially in parallel to the second exemplary axis, $A_2$.

Each of the plurality of alternate matrix apertures 121 is formed by an elongate slot. An alternate matrix aperture 121 is formed between each substantially "X" or "+" shaped matrix aperture 120'. In various exemplary embodiments, as illustrated, the longitudinal axis, $A_L$, of each elongate slot is arranged so as to be substantially in parallel with the axis, $A_1$ or $A_2$, along which the substantially "X" or "+" shaped matrix apertures 120' are arranged.

The substantially octagonally shaped matrix apertures 120 and the substantially "X" or "+" shaped matrix apertures 120' are arranged, in alternating fashion, at spaced apart locations substantially along or substantially in parallel to the third exemplary axis, $A_3$, or the fourth exemplary axis, $A_4$. In various exemplary embodiments, the substantially octagonally shaped matrix apertures 120 and the substantially "X" or "+" shaped matrix apertures 120' are arranged, in alternating fashion, at equally spaced apart locations substantially along or substantially in parallel to the third exemplary axis, $A_3$, or the fourth exemplary axis, $A_4$.

In various exemplary embodiments, the axis $A_1$ is arranged so as to be a substantially vertical axis, the axis, $A_2$, is arranged so as to be a substantially horizontal axis, and axis $A_3$ and $A_4$ are arranged so as to be substantially diagonal axis. However, it should be appreciated that these are merely exemplary embodiments and are not to be viewed as limiting the arrangement or orientation of the exemplary axes.

It should be appreciated that the substantially octagonally shaped matrix apertures 120 and the substantially "X" or "+" shaped matrix apertures 120' are merely exemplary and alternate shapes may be utilized in place of the substantially octagonally shaped matrix apertures 120 and/or the substantially "X" or "+" shaped matrix apertures 120'.

FIG. 31 illustrates the exemplary embodiment of the repeatable modular attachment matrix 100 pattern of FIG. 30 repeated, in a repeating fashion, as part of a matrix layer 110, attached or coupled to a carrier material 12 according to an exemplary embodiment of the presently disclosed systems, methods, and/or apparatuses.

It should be appreciated that the total number of substantially octagonally shaped matrix apertures 120, substantially "X" or "+" shaped matrix apertures 120', and alternate matrix apertures 121 used to form the modular attachment matrix 100 of the matrix layer 110 is a design choice, based upon the desired area that the modular attachment matrix 100 is to cover, whether attached to a carrier material 12 or as a standalone matrix layer 110. Thus, a matrix layer 110 of any desired size and/or shape may be created by including any number of desired substantially octagonally shaped matrix apertures 120, substantially "X" or "+" shaped matrix apertures 120', and alternate matrix apertures 121.

FIG. 31 illustrates an exemplary embodiment of the modular attachment matrix 100 attached or coupled to a carrier material 12, wherein the modular attachment matrix 100 comprises a plurality of spaced apart, substantially octagonally shaped matrix apertures 120, a plurality of "X" or "+" shaped matrix apertures 120', and a plurality of substantially elongate alternate matrix apertures 121 formed in a repeating pattern. By utilizing such a repeated series of alternating substantially octagonally shaped matrix apertures 120, substantially "X" or "+" shaped matrix apertures 120', and alternate matrix apertures 121, tunnel segments 135, such as the exemplary tunnel segments 135 illustrated, may be joined and utilized between various horizontally, vertically, or diagonally positioned substantially octagonally shaped matrix apertures 120, a plurality of "X or "+" shaped matrix apertures 120', and a plurality of substantially elongate alternate matrix apertures 121.

It should also be appreciated and understood that tunnel segments 135 may be created that begin or terminate with similar or differently shaped matrix apertures 120. For example, an accessory 81 may be attached or coupled to the modular attachment matrix 100 between similarly shaped matrix apertures 120, between a substantially octagonally shaped matrix aperture 120 and an "X or "+" shaped matrix aperture 120', between a substantially octagonally shaped matrix aperture 120 and a substantially elongate alternate matrix aperture 121, or between a substantially "X or "+" shaped matrix aperture 120' and a substantially elongate alternate matrix aperture 121.

Tunnel segments 135 may also be created along a substantially horizontal axis, along a substantially vertical axis, or along a substantially diagonal axis.

In various exemplary, nonlimiting embodiments, the matrix layer 110 is attached or coupled to a portion of the carrier material 12 by stitching proximate a perimeter of the matrix layer 110. The matrix layer 110 may then optionally be further attached or coupled to the carrier material 12, via additional matrix layer attachment elements 130. The matrix layer attachment elements 130 are spaced apart, as necessary or desirable, in order to further secure, attach, or couple the matrix layer 110 to the carrier material 12. The number and placement of additional matrix layer attachment elements 130 is a design choice based upon the desired level of securement of the matrix layer 110 to the carrier material 12 and/or to further ensure that the matrix layer 110 will not separate or pull away from the carrier material 12, particularly if accessories are attached or coupled to the matrix layer 110.

In certain exemplary embodiments, the matrix layer attachment elements 130 comprise stitching. Alternatively, the matrix layer 110 may be attached or coupled to the carrier material 12 (either proximate a perimeter or at matrix layer attachment elements 130) via stitching, adhesive bonding, welding, screws, rivets, pins, mating hook and loop portions, snap or releasable fasteners, or other known or later developed means or methods for permanently or releasably attaching or coupling the matrix layer 110 to the carrier material 12.

In addition to the variability of size and shape of the matrix layer 110, the orientation of the matrix layer 110, relative to the carrier material 12, is also a design choice. Thus, it should be appreciated that the matrix layer 110 may be attached at any desired angular or rotational orientation relative to a surface of the carrier material 12.

Portions of material of the matrix layer 110 between substantially square shaped matrix apertures 120 and/or substantially elongate alternate matrix apertures 121 form matrix tunnel segments 135. If the matrix layer 110 is attached to a carrier material 12, the matrix tunnel segments 135 are formed between the matrix layer 110 and the surface of the carrier material 12. The matrix tunnel segments 135 provide areas for securing the accessory coupling element 88 of an accessory 81 to the matrix layer 110. In this manner, an accessory coupling element 88 may be interwoven between the aligned matrix tunnel segments 135 to removably attach the accessory 81 to the carrier material 12.

It should be appreciated that the length of each tunnel segment 135 is dictated by the size and shape of the matrix layer 110 and the distance between substantially square shaped matrix apertures 120 and/or substantially elongate alternate matrix apertures 121.

It should also be understood that tunnel segments 135 may be formed between substantially square shaped matrix apertures 120, between substantially elongate alternate matrix apertures 121, or between substantially square shaped matrix apertures 120 and substantially elongate alternate matrix apertures 121.

During attachment of an exemplary accessory 81, as described herein, the accessory 81 is aligned with the matrix layer 110 in a desired orientation. As illustrated by the exemplary tunnel segments 135, the accessory 81 may optionally be aligned with the matrix layer 110 in a generally vertical manner, in a generally horizontal manner, or in a generally oblique or diagonal manner. It should be understood that these orientations are relative to the orientation of the matrix layer 110 and the orientation of the matrix layer 110 relative to the carrier material 12.

Thus, an accessory 81 may be mounted to the matrix layer 110 between substantially square shaped matrix apertures 120, substantially elongate alternate matrix apertures 121, or substantially square shaped matrix apertures 120 and substantially elongate alternate matrix apertures 121, in a variety of orientations.

It should be appreciated that a more detailed explanation of the instructions regarding how to interweave the accessory coupling element 88 between the substantially square shaped matrix apertures 120, substantially elongate alternate matrix apertures 121, and accessory webbing elements 83 is not provided herein because it is believed that the level of description provided herein is sufficient to enable one of ordinary skill in the art to understand and practice the systems, methods, and apparatuses, as described.

It should be appreciated that these are merely exemplary and not exhaustive examples of the sizes, shapes, and relative placements of exemplary matrix apertures 120 and/or alternate matrix apertures 121. Therefore, each of the matrix apertures 120 and/or alternate matrix apertures 121 may generally be formed in the shape of a triangle, a square, a rectangle, a pentagon, a hexagon (as illustrated in FIG. 13), a heptagon, an octagon, a nanogon, a decagon, a pentadecagon, an icosagon, a circle (as illustrated in FIG. 14), an oval, an "X", a "+", a slot, a dumbbell/barbell shape, or any other desired shape or configuration. Thus, it should be appreciated that the size and shape of each of the matrix apertures 120 and/or alternate matrix apertures 121 is a design choice based upon the desired functionality and/or appearance of the modular attachment matrix 100 and/or the matrix layer 110.

While the presently disclosed systems, methods, and/or apparatuses has been described in conjunction with the exemplary embodiments outlined above, the foregoing description of exemplary embodiments of the presently disclosed systems, methods, and/or apparatuses, as set forth above, are intended to be illustrative, not limiting and the fundamental disclosed systems, methods, and/or apparatuses should not be considered to be necessarily so constrained. It is evident that the presently disclosed systems, methods, and/or apparatuses is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the presently disclosed systems, methods, and/or apparatuses, subject to any specifically excluded limit in the stated range. Where the stated range includes one or both of the limits, ranges excluding either or both of those included limits are also included in the presently disclosed systems, methods, and/or apparatuses.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the presently disclosed systems, methods, and/or apparatuses and elements or methods similar or equivalent to those described herein can be used in practicing the presently disclosed systems, methods, and/or apparatuses. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A modular attachment matrix, comprising:

a portion of carrier material; and a matrix layer, wherein said matrix layer comprises a plurality of spaced apart, substantially octagonally shaped matrix apertures, wherein each of said matrix apertures is formed through said matrix layer and is defined by one or more continuous edges, wherein proximate centers of adjacent matrix apertures are offset by approximately ±90° or by approximately ±45°, and wherein said matrix apertures are arranged in a repeating sequence of equally spaced rows and equally spaced columns, and wherein said matrix layer is at least partially attached or coupled to at least a portion of said carrier material.

2. The modular attachment matrix of claim 1, wherein adjacent edges of vertically, horizontally, obliquely, or diagonally adjacent matrix apertures are substantially parallel to one another.

3. The modular attachment matrix of claim 1, wherein matrix tunnel segments are created between adjacent matrix apertures.

4. The modular attachment matrix of claim 1, wherein matrix tunnel segments are created between vertically adjacent matrix apertures, between horizontally adjacent matrix apertures, between obliquely adjacent matrix apertures, and/or between diagonally adjacent matrix apertures.

5. The modular attachment matrix of claim 1, further comprising one or more alternate attachment apertures formed through said matrix layer at spaced apart locations, wherein each alternate attachment aperture is of a size and/or shape that is different from a size and/or shape of said matrix apertures, and wherein said alternate attachment apertures are arranged in a repeating sequence of equally spaced rows and equally spaced columns.

6. The modular attachment matrix of claim 1, wherein each adjacent column of spaced apart matrix apertures is offset such that at least edges or proximate centers of adjacent matrix apertures are offset by approximately ±45°.

7. The modular attachment matrix of claim 1, wherein each adjacent column of spaced apart matrix apertures is offset such that at least edges or proximate centers of adjacent matrix apertures are offset by approximately ±90°.

8. The modular attachment matrix of claim 1, wherein each matrix aperture is separated from each other matrix aperture by a distance that is equal to or greater than a width of each matrix aperture.

9. The modular attachment matrix of claim 1, wherein said matrix layer comprises chlorosulfonated polyethylene (CSPE) synthetic rubber (CSM).

10. The modular attachment matrix of claim 1, wherein said matrix layer comprises a portion of Hypalon fabric.

11. A modular attachment matrix, comprising:

a matrix layer, wherein said matrix layer comprises a plurality of spaced apart, substantially octagonally shaped matrix apertures, wherein each of said matrix apertures is formed through said matrix layer and is defined by one or more continuous edges, wherein proximate centers of adjacent matrix apertures are offset by approximately ±90° or by approximately ±45°, and wherein said matrix apertures are arranged in a repeating or semi-repeating series or sequence of equally spaced rows and equally spaced columns.

12. The modular attachment matrix of claim 11, wherein said matrix layer is at least partially attached or coupled to at least a portion of a carrier material.

13. The modular attachment matrix of claim 11, wherein each adjacent column of spaced apart matrix apertures is offset such that at least edges or proximate centers of adjacent matrix apertures are offset by approximately ±45°.

14. The modular attachment matrix of claim 11, wherein each adjacent column of spaced apart matrix apertures is offset such that at least edges or proximate centers of adjacent matrix apertures are offset by approximately ±90°.

15. The modular attachment matrix of claim 11, further comprising one or more alternate attachment apertures formed through said matrix layer at spaced apart locations, wherein each alternate attachment aperture is of a size and/or shape that is different from a size and/or shape of said matrix apertures, and wherein said alternate attachment apertures are arranged in a repeating sequence of equally spaced rows and equally spaced columns.

16. A modular attachment matrix, comprising:

a matrix layer, wherein said matrix layer comprises a plurality of spaced apart matrix apertures, wherein said matrix apertures are substantially octagonally shaped matrix apertures arranged in a repeating sequence of equally spaced rows of said substantially octagonally shaped matrix apertures and equally spaced columns of said substantially octagonally shaped matrix apertures, and wherein proximate centers of adjacent matrix apertures are offset by approximately ±90° or by approximately ±45°.

17. The modular attachment matrix of claim 16, wherein each adjacent column of spaced apart matrix apertures is offset such that at least edges or proximate centers of adjacent matrix apertures are offset by approximately ±45°.

18. The modular attachment matrix of claim 16, wherein each adjacent column of spaced apart matrix apertures is offset such that at least edges or proximate centers of adjacent matrix apertures are offset by approximately ±90°.

19. The modular attachment matrix of claim 16, further comprising one or more alternate attachment apertures formed through said matrix layer at spaced apart locations, wherein each alternate attachment aperture is of a size and/or shape that is different from a size and/or shape of said matrix apertures, and wherein said alternate attachment apertures are arranged in a repeating sequence of equally spaced rows and equally spaced columns.

20. The modular attachment matrix of claim 16, wherein said matrix layer is at least partially attached or coupled to at least a portion of a carrier material.

* * * * *